US011085001B2

(12) United States Patent
Garcia Castro et al.

(10) Patent No.: US 11,085,001 B2
(45) Date of Patent: Aug. 10, 2021

(54) COPOLYMERS AS ADDITIVES FOR FUELS AND LUBRICANTS

(71) Applicant: BASF SE, Ludwigshafen (DE)

(72) Inventors: Ivette Garcia Castro, Ludwigshafen (DE); Maxim Peretolchin, Lambrecht (DE); Jochen Mezger, Lautersheim (DE); Klaus Muehlbach, Gruenstadt (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 15/744,416

(22) PCT Filed: Jul. 12, 2016

(86) PCT No.: PCT/EP2016/066465
§ 371 (c)(1),
(2) Date: Jan. 12, 2018

(87) PCT Pub. No.: WO2017/009305
PCT Pub. Date: Jan. 19, 2017

(65) Prior Publication Data

US 2018/0201855 A1 Jul. 19, 2018

(30) Foreign Application Priority Data

Jul. 16, 2015 (EP) ..... 15177078

(51) Int. Cl.
*C10L 1/32* (2006.01)
*C10L 1/18* (2006.01)
(Continued)

(52) U.S. Cl.
CPC ..... *C10L 1/1966* (2013.01); *C10L 10/04* (2013.01); *C10L 10/06* (2013.01); *C10M 145/16* (2013.01);
(Continued)

(58) Field of Classification Search
CPC ... C10M 145/16; C10M 145/12; C10L 1/146; C10L 1/1881; C10L 1/1883
(Continued)

(56) References Cited

U.S. PATENT DOCUMENTS 4,491,455 A 1/1985 Ishizaki et al.
4,655,946 A 4/1987 Metro et al.
(Continued)

FOREIGN PATENT DOCUMENTS

CN 104513678 A 4/2015
DE 3733172 A1 4/1989
(Continued)

OTHER PUBLICATIONS

International Search Report dated Sep. 13, 2016, in PCT/EP2016/066455, filed Jul. 12, 2016.
(Continued)

*Primary Examiner* — Prem C Singh
*Assistant Examiner* — Francis C Campanell
(74) *Attorney, Agent, or Firm* — Grüneberg and Myers PLLC

(57) ABSTRACT

Novel uses of copolymers for removing and/or reducing the level of deposits in the fuel system and/or injection system of direct injection diesel and/or gasoline engines are provided. What is provided is the use of particular copolymers as fuel additive or lubricant additive; to processes for preparation of such additives, and fuels and lubricants added therewith, such as, more particularly, as a detergent additive; to use of these copolymers for reducing the level of or preventing deposits in the fuel systems and especially the injection systems of direct injection diesel engines, especially in common rail injection systems, for reducing the fuel consumption of direct injection diesel engines, especially of diesel engines with common rail injection systems, and for
(Continued)

| step | duration (minutes) | engine speed (rpm) +/- 25 | load (%) | torque (Nm) +/- 5 | boost air after IC (°C) +/- 3 |
|---|---|---|---|---|---|
| 1 | 2' | 1750 | (20) | 62 | 45 |
| 2 | 7' | 3000 | (60) | 173 | 50 |
| 3 | 2' | 1750 | (20) | 62 | 45 |
| 4 | 7' | 3800 | (80) | 212 | 50 |
| 5 | 2' | 1750 | (20) | 62 | 45 |
| 6 | 10' | 4000 | 100 | * | 50 |
| 7 | 2' | 1250 | (10) | 25 | 43** |
| 8 | 7' | 3000 | 100 | * | 50 |
| 9 | 2' | 1250 | (10) | 25 | 43** |
| 10 | 10' | 2000 | 100 | * | 50 |
| 11 | 2' | 1250 | (10) | 25 | 43** |
| 12 | 7' | 4000 | 100 | * | 50 |
| Σ = 1 hour | | | | | |

* for expected range see appendix 96.3
** target only minimizing power loss in direct injection diesel engines, especially in diesel engines with common rail injection systems; and as an additive for gasoline fuels, especially for operation of DISI engines.

20 Claims, 1 Drawing Sheet

(51) Int. Cl.

| | |
|---|---|
| ***C10M 169/04*** | (2006.01) |
| ***C10L 1/196*** | (2006.01) |
| ***C10L 10/04*** | (2006.01) |
| ***C10L 10/06*** | (2006.01) |
| ***C10M 145/16*** | (2006.01) |
| *C10L 1/236* | (2006.01) |
| *C10L 1/197* | (2006.01) |
| *C10N 30/04* | (2006.01) |
| *C10N 40/25* | (2006.01) |

(52) U.S. Cl.
CPC ..... *C10L 1/1973* (2013.01); *C10L 1/2362* (2013.01); *C10L 1/2364* (2013.01); *C10L 1/2366* (2013.01); *C10L 1/2368* (2013.01); *C10L 2200/0446* (2013.01); *C10L 2270/023* (2013.01); *C10L 2270/026* (2013.01); *C10M 2209/086* (2013.01); *C10N 2030/04* (2013.01); *C10N 2040/25* (2013.01)

(58) Field of Classification Search
USPC ..... 508/306; 44/301
See application file for complete search history.

(56) References Cited

U.S. PATENT DOCUMENTS

| | | | |
|---|---|---|---|
| 4,877,416 | A | 10/1989 | Campbell |
| 5,071,919 | A | 12/1991 | DeGonia et al. |
| 5,214,224 | A | 5/1993 | Comer et al. |
| 5,232,963 | A | 8/1993 | Comer et al. |
| 5,332,491 | A | 7/1994 | Fisher et al. |
| 5,670,462 | A | 9/1997 | Barr et al. |
| 5,766,273 | A | 6/1998 | Dralle-Voss et al. |
| 5,883,196 | A | 3/1999 | Rath et al. |
| 6,743,266 | B2 | 6/2004 | DeRosa et al. |
| 10,377,958 | B2 | 8/2019 | Mezger et al. |
| 10,844,308 | B2 | 11/2020 | Mezger et al. |
| 2004/0182743 | A1 | 9/2004 | MacMillan |
| 2007/0094918 | A1 | 5/2007 | Sawhney et al. |
| 2011/0271926 | A1* | 11/2011 | Cracknell ..... C10L 1/06 123/1 A |
| 2011/0315107 | A1* | 12/2011 | Grabarse ..... C08F 222/06 123/1 A |
| 2013/0239465 | A1* | 9/2013 | Morgan ..... C10L 1/1641 44/351 |
| 2015/0096516 | A1 | 4/2015 | Fang et al. |
| 2016/0130514 | A1 | 5/2016 | Hansch et al. |
| 2017/0183590 | A1 | 6/2017 | Mezger et al. |
| 2018/0182506 | A1 | 6/2018 | Gao et al. |
| 2018/0201863 | A1 | 7/2018 | Mezger et al. |
| 2018/0251692 | A1 | 9/2018 | Mezger et al. |
| 2019/0016987 | A1 | 1/2019 | Csihony et al. |
| 2019/0218471 | A1 | 7/2019 | Mezger et al. |
| 2019/0249099 | A1 | 8/2019 | Peretolchin et al. |
| 2020/0056109 | A1 | 2/2020 | Peretolchin et al. |
| 2020/0308486 | A1 | 10/2020 | Mezger et al. |

FOREIGN PATENT DOCUMENTS

| | | | |
|---|---|---|---|
| DE | 3826608 | A1 | 2/1990 |
| DE | 3838918 | A1 | 5/1990 |
| DE | 4142241 | A1 | 6/1993 |
| DE | 4309074 | A1 | 9/1994 |
| DE | 19620262 | A1 | 11/1997 |
| DE | 10102913 | A1 | 7/2002 |
| EP | 0061895 | A2 | 10/1982 |
| EP | 0 156 310 | | 10/1985 |
| EP | 0 235 868 | | 9/1987 |
| EP | 0244616 | A2 | 11/1987 |
| EP | 0261957 | A2 | 3/1988 |
| EP | 0307815 | A1 | 3/1989 |
| EP | 0310875 | A1 | 4/1989 |
| EP | 0356725 | A1 | 3/1990 |
| EP | 0452328 | | 10/1991 |
| EP | 0 457 599 | | 11/1991 |
| EP | 0476485 | A1 | 3/1992 |
| EP | 0548617 | A2 | 6/1993 |
| EP | 0639632 | A1 | 2/1995 |
| EP | 0700985 | A1 | 3/1996 |
| EP | 0831141 | A1 | 3/1998 |
| GB | 2496514 | A | 5/2013 |
| JP | 2007-77216 | A | 3/2007 |
| WO | 87/01126 | A1 | 2/1987 |
| WO | 91/03529 | | 3/1991 |
| WO | 93/18115 | A1 | 9/1993 |
| WO | 94/24231 | A1 | 10/1994 |
| WO | 96/03367 | A1 | 2/1996 |
| WO | 96/03479 | A1 | 2/1996 |
| WO | 97/03946 | A1 | 2/1997 |
| WO | 98/04656 | A1 | 2/1998 |
| WO | 99/29748 | A1 | 6/1999 |
| WO | 00/44857 | A2 | 8/2000 |
| WO | 00/47698 | A1 | 8/2000 |
| WO | 2004/024850 | | 3/2004 |
| WO | 2004/035715 | A1 | 4/2004 |
| WO | 2005/054314 | A2 | 6/2005 |
| WO | 2006/135881 | A2 | 12/2006 |
| WO | 2007/042887 | A1 | 4/2007 |
| WO | 2008/060888 | A2 | 5/2008 |
| WO | 2010/042378 | | 4/2010 |
| WO | 2010/132259 | A1 | 11/2010 |
| WO | 2011/095819 | A1 | 8/2011 |
| WO | 2011/110860 | A1 | 9/2011 |
| WO | 2011/146289 | A1 | 11/2011 |
| WO | 2011/161149 | A1 | 12/2011 |
| WO | 2012/004300 | A1 | 1/2012 |
| WO | 2013/070503 | A1 | 5/2013 |
| WO | 2014/195464 | A1 | 12/2014 |
| WO | 2015/113681 | A1 | 8/2015 |

OTHER PUBLICATIONS

European Search Report dated Jan. 29, 2016 in Patent Application No. 15177078.1, (with English translation of categories of cited documents), 4 pages.
Submitting International Search Report dated Sep. 13, 2016 in PCT/EP2016/066465, (English translation previously filed) 4 pages.
Office Action dated Oct. 8, 2019, in Chinese Patent Application No. 201680041540.1 filed Jul. 12, 2016 (citing document AO).
Extended European Search Report dated Oct. 14, 2016 in European Patent Application No. 16177922.8 (with English translation), 4 Pages.
Final Rejection dated Jan. 11, 2021 in U.S. Appl. No. 16/313,751, 20 Pages.
International Search Report dated Jul. 25, 2017 in PCT/EP2017/065751 filed Jun. 27, 2017 with English translation, 8 Pages.

* cited by examiner

| step | duration (minutes) | engine speed (rpm) +/- 20 | load (%) | torque (Nm) +/- 5 | Boost air after IC (°C) +/-3 |
|---|---|---|---|---|---|
| 1 | 2' | 1750 | (20) | 62 | 45 |
| 2 | 7' | 3000 | (60) | 173 | 50 |
| 3 | 2' | 1750 | (20) | 62 | 45 |
| 4 | 7' | 3500 | (80) | 212 | 50 |
| 5 | 2' | 1750 | (20) | 62 | 45 |
| 6 | 10' | 4000 | 100 | * | 50 |
| 7 | 2' | 1250 | (10) | 25 | 43** |
| 8 | 7' | 3000 | 100 | * | 50 |
| 9 | 2' | 1250 | (10) | 25 | 43** |
| 10 | 10' | 2000 | 100 | * | 50 |
| 11 | 2' | 1250 | (10) | 25 | 43** |
| 12 | 7' | 4000 | 100 | * | 50 |
| | ∑= 1 hour | | | | |
* for expected range see appendix 06.5
** target only
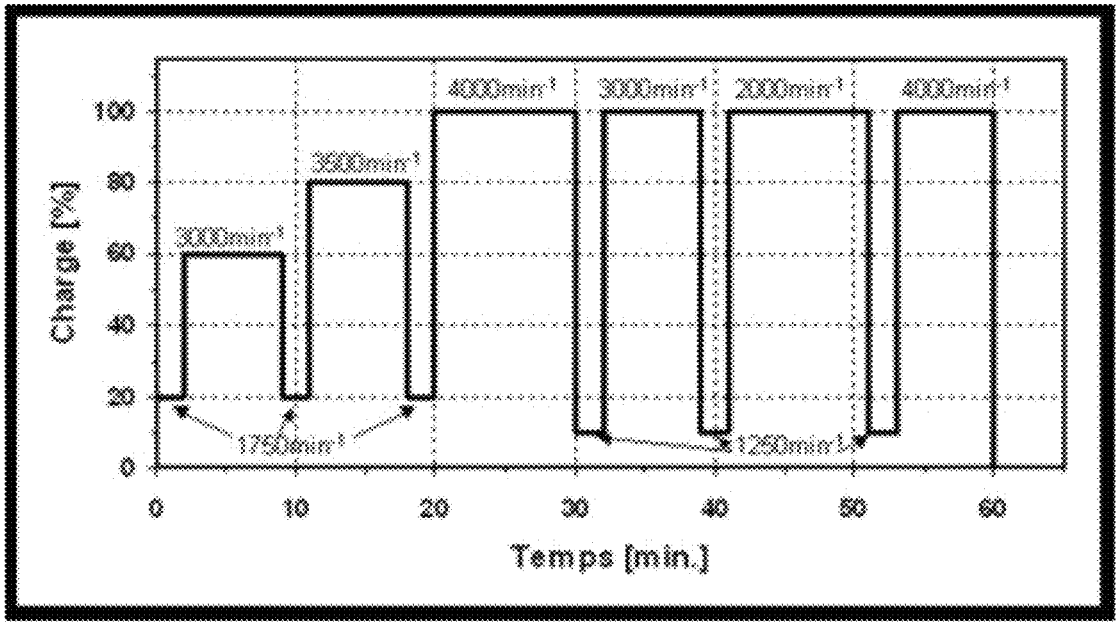

COPOLYMERS AS ADDITIVES FOR FUELS AND LUBRICANTS

The present invention relates to novel uses of copolymers for removing and/or reducing the level of deposits in the fuel system and/or injection system of direct injection diesel and/or gasoline engines.

The present invention relates to the use of particular copolymers as fuel additive or lubricant additive; to processes for preparation of such additives, and fuels and lubricants additized therewith, such as, more particularly, as a detergent additive; to use of these copolymers for reducing the level of or preventing deposits in the fuel systems and especially the injection systems of direct injection diesel engines, especially in common rail injection systems, for reducing the fuel consumption of direct injection diesel engines, especially of diesel engines with common rail injection systems, and for minimizing power loss in direct injection diesel engines, especially in diesel engines with common rail injection systems; and as an additive for gasoline fuels, especially for operation of DISI engines.

BACKGROUND OF THE INVENTION

In direct injection diesel engines, the fuel is injected and distributed ultrafinely (nebulized) by a multihole injection nozzle which reaches directly into the combustion chamber of the engine, instead of being introduced into a prechamber or swirl chamber as in the case of the conventional (chamber) diesel engine. The advantage of direct injection diesel engines lies in their high performance for diesel engines and nevertheless low fuel consumption. Moreover, these engines achieve a very high torque even at low speeds.

At present, essentially three methods are being used for injection of the fuel directly into the combustion chamber of the diesel engine: the conventional distributor injection pump, the pump-nozzle system (unit-injector system or unit-pump system), and the common rail system.

In the common rail system, the diesel fuel is conveyed by a pump with pressures up to 2000 bar into a high-pressure line, the common rail. Proceeding from the common rail, branch lines run to the different injectors which inject the fuel directly into the combustion chamber. The full pressure is always applied to the common rail, which enables multiple injection or a specific injection form. In the other injection systems, in contrast, only a smaller variation in the injection is possible. Injection in the common rail is divided essentially into three groups: (1.) pre-injection, by which essentially softer combustion is achieved, such that harsh combustion noises ("nailing") are reduced and the engine seems to run quietly; (2.) main injection, which is responsible especially for a good torque profile; and (3.) post-injection, which especially ensures a low $NO_x$ value. In this post-injection, the fuel is generally not combusted, but instead vaporized by residual heat in the cylinder. The exhaust gas/fuel mixture formed is transported to the exhaust gas system, where the fuel, in the presence of suitable catalysts, acts as a reducing agent for the nitrogen oxides $NO_x$.

The variable, cylinder-individual injection in the common rail injection system can positively influence the pollutant emission of the engine, for example the emission of nitrogen oxides ($NO_x$), carbon monoxide (CO) and especially of particulates (soot). This makes it possible, for example, for engines equipped with common rail injection systems to meet the Euro 4 standard theoretically even without additional particulate filters.

In modern common rail diesel engines, under particular conditions, for example when biodiesel-containing fuels or fuels with metal impurities such as zinc compounds, copper compounds, lead compounds and other metal compounds are used, deposits can form on the injector orifices, which adversely affect the injection performance of the fuel and hence impair the performance of the engine, i.e. especially reduce the power, but in some cases also worsen the combustion. The formation of deposits is enhanced further by further developments in the injector construction, especially by the change in the geometry of the nozzles (narrower, conical orifices with rounded outlet). For lasting optimal functioning of engine and injectors, such deposits in the nozzle orifices must be prevented or reduced by suitable fuel additives.

In the injection systems of modern diesel engines, deposits cause significant performance problems. It is common knowledge that such deposits in the spray channels can lead to a decrease in the fuel flow and hence to power loss. Deposits at the injector tip, in contrast, impair the optimal formation of fuel spray mist and, as a result, cause worsened combustion and associated higher emissions and increased fuel consumption. In contrast to these conventional "external" deposition phenomena, "internal" deposits (referred to collectively as internal diesel injector deposits (IDID)) in particular parts of the injectors, particularly at the nozzle needle, at the control piston, at the valve piston, at the valve seat, in the control unit and in the guides of these components, also increasingly cause performance problems. Conventional additives exhibit inadequate action against these IDIDs.

The "injection system" is understood to mean the part of the fuel system in motor vehicles from the fuel pump up to and including the injector outlet. "Fuel system" is understood to mean the components of motor vehicles that are in contact with the particular fuel, preferably the region from the tank up to and including the injector outlet.

In one embodiment of the present invention, the inventive compounds counteract deposits not just in the injection system but also in the rest of the fuel system, here especially deposits in fuel filters and pumps.

WO 2011/146289 describes nitrogen-free additives formed from a substituted hydrocarbon having at least two carboxyl groups in free form or in anhydride form for improving detergency in fuel systems. Examples disclosed include hydrocarbyl-substituted succinic anhydrides and hydrolyzed forms thereof.

U.S. Pat. No. 5,766,273 discloses using polymer mixtures comprising copolymers of maleic anhydride and α-olefins as one component as additives for mineral oil distillates for improving the flow properties, especially the cloud point (CP) and the cold filter plugging point (CFPP).

U.S. Pat. No. 5,670,462 describes copolymers of maleic anhydride and $C_4$ to $C_{30}$ olefins. There is no description of use to counteract deposits.

JP 2007-077216 describes oils comprising partial esters of copolymers of maleic anhydride and α-olefins with alkylene glycols. There is no description of any effect of the copolymer against deposits.

International patent application PCT/EP2014/076622, filed Dec. 4, 2014, discloses use of partly or fully hydrolyzed copolymers of maleic anhydride and α-olefins to counteract engine deposits. The hydrolysis level in the examples is at least 15.9% is.

It is an object of the present invention to provide a novel class of copolymer-based additives for use in modern diesel fuels and gasoline fuels.

The object is achieved by
the use of copolymers obtainable by
in a first reaction step (I) copolymerizing
(A) at least one ethylenically unsaturated mono- or dicarboxylic acid or derivatives thereof, preferably a dicarboxylic acid or derivatives thereof, more preferably the anhydride of a dicarboxylic acid,
(B) at least one α-olefin having from at least 12 up to and including 30 carbon atoms,
(C) optionally at least one further aliphatic or cycloaliphatic olefin which has at least 4 carbon atoms and is different than (B) and
(D) optionally one or more further copolymerizable monomers other than monomers (A), (B) and (C), selected from the group consisting of
(Da) vinyl esters,
(Db) vinyl ethers,
(Dc) (meth)acrylic esters of alcohols having at least 5 carbon atoms.
(Dd) allyl alcohols or ethers thereof,
(De) N-vinyl compounds selected from the group consisting of vinyl compounds of heterocycles containing at least one nitrogen atom, N-vinylamides or N-vinyllactams,
(Df) ethylenically unsaturated aromatics,
(Dg) α,β-ethylenically unsaturated nitriles,
(Dh) (meth)acrylamides and
(Di) allylamines.
followed by
in a second optional reaction step (II) partly hydrolyzing the anhydride functionalities present in the copolymer obtained from (I) and/or partly hydrolyzing carboxylic ester functionalities present in the copolymer obtained from (I), with the proviso that more than 90% of the anhydride and carboxylic ester functionalities present remain intact after reaction step (II), for removing and/or preventing deposits in the fuel system and/or injection system of direct injection diesel and/or gasoline engines.

Copolymers of this kind have been found to be effective in suppressing and/or eliminating the following deposits in diesel and gasoline engines:

SUMMARY OF THE INVENTION

These copolymers have the particular feature that they act against a wide variety of different deposits which impair the performance of modern diesel engines. The inventive compounds act, for example, against power loss both caused by introduction of zinc and caused by introduction of sodium into the diesel fuel. In doing so, deposits in the spray channels and the injector tip are essentially eliminated or avoided. Secondly, the inventive compounds also counteract internal diesel injector deposits (IDIDs) caused by Na, Ca and/or K ions (called Na, Ca and K soap IDIDs respectively) and/or polymeric deposits. Na, Ca and K soap IDIDs are deposits comprising the metal ions in question with any desired counterions. The polymeric deposits, in contrast, are free of metal ions and are attributable to organic material of high molecular weight having zero or sparing solubility in the fuel.

DESCRIPTION OF FIGURES

FIG. 1 shows the running of a one-hour engine test cycle according to CEC F-098-08.

A1) SPECIFIC EMBODIMENTS

Specific embodiments of the invention are:

1. The use of copolymers obtainable by
in a first reaction step (I) copolymerizing
(A) at least one ethylenically unsaturated mono- or dicarboxylic acid or derivatives thereof, preferably a dicarboxylic acid or derivatives thereof, more preferably the anhydride of a dicarboxylic acid,
(B) at least one α-olefin having from at least 12 up to and including 30 carbon atoms,
(C) optionally at least one further aliphatic or cycloaliphatic olefin which has at least 4 carbon atoms and is different than (B) and
(D) optionally one or more further copolymerizable monomers other than monomers (A), (B) and (C), selected from the group consisting of
(Da) vinyl esters,
(Db) vinyl ethers,
(Dc) (meth)acrylic esters of alcohols having at least 5 carbon atoms,
(Dd) allyl alcohols or ethers thereof,
(De) N-vinyl compounds selected from the group consisting of vinyl compounds of heterocycles containing at least one nitrogen atom, N-vinylamides or N-vinyllactams,
(Df) ethylenically unsaturated aromatics,
(Dg) α,β-ethylenically unsaturated nitriles,
(Dh) (meth)acrylamides and
(Di) allylamines,
followed by
in a second optional reaction step (II) partly hydrolyzing the anhydride functionalities present in the copolymer obtained from (I) and/or partly hydrolyzing carboxylic ester functionalities present in the copolymer obtained from (I), with the proviso that more than 90% of the anhydride and carboxylic ester functionalities present remain intact after reaction step (II), as fuel additive or lubricant additive, especially diesel fuel additive.
2. The use according to embodiment 1 as an additive for reducing the fuel consumption of direct injection diesel engines, especially of diesel engines with common rail injection systems.
3. The use according to either of the embodiments as an additive for minimizing power loss in direct injection diesel engines, especially in diesel engines with common rail injection systems.
4. The use according to any of the embodiments as an additive for minimizing power loss caused by K, Zn, Ca and/or Na ions (called K. Zn, Ca and Na power loss respectively).
5. The use according to any of the embodiments as a gasoline fuel additive for reducing the level of deposits in the intake system of a gasoline engine, such as, more particularly, DISI and PFI (port fuel injector) engines.
6. The use according to any of the embodiments as a diesel fuel additive for reducing and/or preventing deposits in the fuel systems, especially injection systems, such as, more particularly, the internal diesel injector deposits (IDIDs), and/or valve sticking in direct injection diesel engines, especially in common rail injection systems.
7. The use according to any of the embodiments as a diesel fuel additive for reducing and/or preventing the internal diesel injector deposits (IDIDs) caused by Na, Ca and/or K ions (called Na, Ca and K soap IDIDs respectively).
8. The use according to any of the embodiments as a diesel fuel additive for reducing and/or preventing the internal diesel injector deposits (IDIDs) caused by polymeric deposits.

9. The use according to any of the preceding embodiments, wherein the fuel is selected from diesel fuels, biodiesel fuels, gasoline fuels, and alkanol-containing gasoline fuels.

10. An additive concentrate comprising, in combination with further diesel or gasoline fuel additives or lubricant additives, at least one copolymer obtainable by in a first reaction step (I) copolymerizing (A) at least one ethylenically unsaturated mono- or dicarboxylic acid or derivatives thereof, preferably a dicarboxylic acid or derivatives thereof, more preferably the anhydride of a dicarboxylic acid, (B) at least one α-olefin having from at least 12 up to and including 30 carbon atoms, (C) optionally at least one further aliphatic or cycloaliphatic olefin which has at least 4 carbon atoms and is different than (B) and (D) optionally one or more further copolymerizable monomers other than monomers (A), (B) and (C), selected from the group consisting of (Da) vinyl esters, (Db) vinyl ethers, (Dc) (meth)acrylic esters of alcohols having at least 5 carbon atoms, (Dd) allyl alcohols or ethers thereof, (De) N-vinyl compounds selected from the group consisting of vinyl compounds of heterocycles containing at least one nitrogen atom, N-vinylamides or N-vinyllactams, (Df) ethylenically unsaturated aromatics, (Dg) α,β-ethylenically unsaturated nitriles, (Dh) (meth)acrylamides and (Di) allylamines, followed by in a second optional reaction step (II) partly hydrolyzing the anhydride functionalities present in the copolymer obtained from (I) and/or partly hydrolyzing carboxylic ester functionalities present in the copolymer obtained from (I), with the proviso that more than 90% of the anhydride and carboxylic ester functionalities present remain intact after reaction step (II).

11. A fuel composition, lubricant composition or kerosene composition, especially diesel fuel composition, comprising a copolymer obtainable by in a first reaction step (I) copolymerizing (A) at least one ethylenically unsaturated mono- or dicarboxylic acid or derivatives thereof, preferably a dicarboxylic acid or derivatives thereof, more preferably the anhydride of a dicarboxylic acid, (B) at least one α-olefin having from at least 12 up to and including 30 carbon atoms, (C) optionally at least one further aliphatic or cycloaliphatic olefin which has at least 4 carbon atoms and is different than (B) and (D) optionally one or more further copolymerizable monomers other than monomers (A), (B) and (C), selected from the group consisting of (Da) vinyl esters, (Db) vinyl ethers, (Dc) (meth)acrylic esters of alcohols having at least 5 carbon atoms, (Dd) allyl alcohols or ethers thereof, (De) N-vinyl compounds selected from the group consisting of vinyl compounds of heterocycles containing at least one nitrogen atom, N-vinylamides or N-vinyllactams, (Df) ethylenically unsaturated aromatics, (Dg) α,β-ethylenically unsaturated nitriles, (Dh) (meth)acrylamides and (Di) allylamines, followed by in a second optional reaction step (II) partly hydrolyzing the anhydride functionalities present in the copolymer obtained from (I) and/or partly hydrolyzing carboxylic ester functionalities present in the copolymer obtained from (I), with the proviso that more than 90% of the anhydride and carboxylic ester functionalities present remain intact after reaction step (11).

Description of the Copolymer

The monomer (A) is at least one, preferably one to three, more preferably one or two and most preferably exactly one ethylenically unsaturated, preferably α,β-ethylenically unsaturated, mono- or dicarboxylic acid(s) or derivatives thereof, preferably a dicarboxylic acid or derivatives thereof, more preferably the anhydride of a dicarboxylic acid, most preferably maleic anhydride.

Derivatives are understood to mean the corresponding anhydrides in monomeric or else polymeric form, mono- or dialkyl esters, preferably mono- or di-$C_1$-$C_4$-alkyl esters, more preferably mono- or dimethyl esters or the corresponding mono- or diethyl esters, and mixed esters, preferably mixed esters having different $C_1$-$C_4$ alkyl components, more preferably mixed methyl ethyl esters.

Preferably, the derivatives are anhydrides in monomeric form or di-$C_1$-$C_4$-alkyl esters, more preferably anhydrides in monomeric form.

In the context of this document, $C_1$-$C_4$-alkyl is understood to mean methyl, ethyl, iso-propyl, n-propyl, n-butyl, isobutyl, sec-butyl and tert-butyl, preferably methyl and ethyl, more preferably methyl.

Examples of α,β-ethylenically unsaturated mono- or dicarboxylic acids are those mono- or dicarboxylic acids or derivatives thereof in which the carboxyl group or, in the case of dicarboxylic acids, at least one carboxyl group, preferably both carboxyl groups, is/are conjugated to the ethylenically unsaturated double bond.

Examples of ethylenically unsaturated mono- or dicarboxylic acids that are not α,β-ethylenically unsaturated are cis-5-norbornene-endo-2,3-dicarboxylic anhydride, exo-3,6-epoxy-1,2,3,6-tetrahydrophthalic anhydride and cis-4-cyclohexene-1,2-dicarboxylic anhydride.

Examples of α,β-ethylenically unsaturated monocarboxylic acids are acrylic acid, methacrylic acid, crotonic acid and ethylacrylic acid, preferably acrylic acid and methacrylic acid, referred to in this document as (meth)acrylic acid for short, and more preferably acrylic acid.

Particularly preferred derivatives of α,β-ethylenically unsaturated monocarboxylic acids are methyl acrylate, ethyl acrylate, n-butyl acrylate and methyl methacrylate.

Examples of dicarboxylic acids are maleic acid, fumaric acid, itaconic acid (2-methylenebutanedioic acid), citraconic acid (2-methylmaleic acid), glutaconic acid (pent-2-ene-1,5-dicarboxylic acid), 2,3-dimethylmaleic acid, 2-methylfumaric acid, 2,3-dimethylfumaric acid, methylenemalonic acid and tetrahydrophthalic acid, preferably maleic acid and fumaric acid and more preferably maleic acid and derivatives thereof.

More particularly, monomer (A) is maleic anhydride.

Monomer (B) is at least one, preferably one to four, more preferably one to three, even more preferably one or two and most preferably exactly one α-olefin(s) having from at least 12 up to and including 30 carbon atoms. The α-olefins (B) preferably have at least 14, more preferably at least 16 and most preferably at least 18 carbon atoms. Preferably, the α-olefins (B) have up to and including 28, more preferably up to and including 26 and most preferably up to and including 24 carbon atoms.

Preferably, the α-olefins may be linear or branched, preferably linear, 1-alkenes.

Examples of these are 1-dodecene, 1-tridecene, 1-tetradecene, 1-pentadecene, 1-hexadecene, 1-heptadecene, 1-octadecene, 1-nonodecene, 1-eicosene, 1-docosene, 1-tetracosene, 1-hexacosene, preference being given to 1-octadecene, 1-eicosene, 1-docosene and 1-tetracosene, and mixtures thereof.

Further examples of α-olefin (B) are those olefins which are oligomers or polymers of $C_2$ to $C_{12}$ olefins, preferably of $C_3$ to $C_{10}$ olefins, more preferably of $C_4$ to $C_6$ olefins. Examples thereof are ethene, propene, 1-butene, 2-butene, isobutene, pentene isomers and hexene isomers, preference being given to ethene, propene, 1-butene, 2-butene and isobutene.

Named examples of α-olefins (B) include oligomers and polymers of propene, 1-butene, 2-butene, isobutene, and mixtures thereof, particularly oligomers and polymers of propene or isobutene or of mixtures of 1-butene and 2-butene. Among the oligomers, preference is given to the trimers, tetramers, pentamers and hexamers, and mixtures thereof.

In addition to the olefin (B), it is optionally possible to incorporate at least one, preferably one to four, more preferably one to three, even more preferably one or two and especially exactly one further aliphatic or cycloaliphatic olefin(s) (C) which has/have at least 4 carbon atoms and is/are different than (B) by polymerization into the inventive copolymer.

The olefins (C) may be olefins having a terminal (α-) double bond or those having a non-terminal double bond, preferably having an α-double bond. The olefin (C) preferably comprises olefins having 4 to fewer than 12 or more than 30 carbon atoms. If the olefin (C) is an olefin having 12 to 30 carbon atoms, this olefin (C) does not have an α-double bond.

Examples of aliphatic olefins (C) are 1-butene, 2-butene, isobutene, pentene isomers, hexene isomers, heptene isomers, octene isomers, nonene isomers, decene isomers, undecene isomers and mixtures thereof.

Examples of cycloaliphatic olefins (C) are cyclopentene, cyclohexene, cyclooctene, cycodecene, cyclododecene, α- or β-pinene and mixtures thereof, limonene and norbornene.

Further examples of olefins (C) are polymers having more than 30 carbon atoms of propene, 1-butene, 2-butene or isobutene or of olefin mixtures comprising the latter, preferably of isobutene or of olefin mixtures comprising the latter, more preferably having a mean molecular weight $M_w$ in the range from 500 to 5000 g/mol, preferably 650 to 3000 and more preferably 800 to 1500 g/mol.

Preferably, the oligomers or polymers comprising isobutene in copolymerized form have a high content of terminal ethylenic double bonds (α-double bonds), for example at least 50 mol %, preferably at least 60 mol %, more preferably at least 70 mol % and most preferably at least 80 mol %.

For the preparation of such oligomers or polymers comprising isobutene in copolymerized form, suitable isobutene sources are either pure isobutene or isobutene-containing C4 hydrocarbon streams, for example C4 raffinates, especially "raffinate 1", C4 cuts from isobutane dehydrogenation, C4 cuts from steamcrackers and from FCC crackers (fluid catalyzed cracking), provided that they have substantially been freed of 1,3-butadiene present therein. A C4 hydrocarbon stream from an FCC refinery unit is also known as a "b/b" stream. Further suitable isobutene-containing C4 hydrocarbon streams are, for example, the product stream of a propylene-isobutane cooxidation or the product stream from a metathesis unit, which are generally used after customary purification and/or concentration. Suitable C4 hydrocarbon streams comprise generally less than 500 ppm, preferably less than 200 ppm, of butadiene. The presence of 1-butene and of cis- and trans-2-butene is substantially uncritical. Typically, the isobutene concentration in said C4 hydrocarbon streams is in the range from 40% to 60% by weight. For instance, raffinate 1 generally consists essentially of 30% to 50% by weight of isobutene, 10% to 50% by weight of 1-butene, 10% to 40% by weight of cis- and trans-2-butene and 2% to 35% by weight of butanes; in the polymerization process of the invention, the unbranched butenes in the raffinate 1 are generally virtually inert, and only the isobutene is polymerized a preferred embodiment, the monomer source used for polymerization is a technical C4 hydrocarbon stream having an isobutene content of 1% to 100% by weight, especially of 1% to 99% by weight, in particular of 1% to 90% by weight, more preferably of 30% to 60% by weight, especially a raffinate 1 stream, a b/b stream from an FCC refinery unit, a product stream from a propylene-isobutane cooxidation or a product stream from a metathesis unit.

Especially when a raffinate 1 stream is used as isobutene source, the use of water as the sole initiator or as further initiator has been found to be useful, particularly when polymerization is effected at temperatures of −20° C. to +30° C., especially of 0° C. to +20° C. At temperatures of −20° C. to +30° C., especially of 0° C. to +20° C., however, it is possible to dispense with the use of an initiator when using a raffinate 1 stream as isobutene source.

Said isobutene-containing monomer mixture may comprise small amounts of contaminants such as water, carboxylic acids or mineral acids without causing any critical yield or selectivity losses. It is appropriate to the purpose to avoid accumulation of these impurities by removing such harmful substances from the isobutene-containing monomer mixture, for example, by adsorption on solid adsorbents such as activated carbon, molecular sieves or ion exchangers.

It is also possible, albeit less preferable, to convert monomer mixtures of isobutene or of the isobutene-containing hydrocarbon mixture with olefinically unsaturated monomers copolymerizable with isobutene. If monomer mixtures of isobutene with suitable comonomers are to be copolymerized, the monomer mixture comprises preferably at least 5% by weight, more preferably at least 10% by weight and especially at least 20% by weight of isobutene, and preferably at most 95% by weight, more preferably at most 90% by weight and especially at most 80% by weight of comonomers.

In a preferred embodiment, the mixture of the olefins (B) and optionally (C), averaged to their molar amounts, have at least 12 carbon atoms, preferably at least 14, more preferably at least 16 and most preferably at least 17 carbon atoms.

For example, a 2:3 mixture of docosene and tetradecene has an averaged value for the carbon atoms of 0.4×22+0.6=14=17.2.

The upper limit is less relevant and is generally not more than 60 carbon atoms, preferably not more than 55, more preferably not more than 50, even more preferably not more than 45 and especially not more than 40 carbon atoms.

The optional monomer (D) is at least one monomer, preferably one to three, more preferably one or two and most preferably exactly one monomer(s) selected from the group consisting of (Da) vinyl esters, (Db) vinyl ethers, (Dc) (meth)acrylic esters of alcohols having at least 5 carbon atoms, (Dd) allyl alcohols or ethers thereof, (De) N-vinyl compounds selected from the group consisting of vinyl compounds of heterocycles containing at least one nitrogen atom, N-vinylamides or N-vinyllactams, (Df) ethylenically unsaturated aromatics and (Dg) α,β-ethylenically unsaturated nitriles, (Dh) (meth)acrylamides and (Di) allylamines.

Examples of vinyl esters (Da) are vinyl esters of $C_2$- to $C_{12}$-carboxylic acids, preferably vinyl acetate, vinyl propionate, vinyl butyrate, vinyl pentanoate, vinyl hexanoate, vinyl octanoate, vinyl 2-ethylhexanoate, vinyl decanoate, and vinyl esters of Versatic Acids 5 to 10, preferably vinyl esters of 2,2-dimethylpropionic acid (pivalic acid, Versatic Acid 5), 2,2-dimethylbutyric acid (neohexanoic acid, Versatic Acid 6), 2,2-dimethylpentanoic acid (neoheptanoic acid, Versatic Acid 7), 2,2-dimethylhexanoic acid (neooctanoic acid, Versatic Acid 8), 2,2-dimethylheptanoic acid (neononanoic acid, Versatic Acid 9) or 2,2-dimethyloctanoic acid (neodecanoic acid, Versatic Acid 10).

Examples of vinyl ethers (Db) are vinyl ethers of $C_1$- to $C_{12}$-alkanols, preferably vinyl ethers of methanol, ethanol, iso-propanol, n-propanol, n-butanol, iso-butanol, sec-butanol, tert-butanol, n-hexanol, n-heptanol, n-octanol, n-decanol, n-dodecanol (lauryl alcohol) or 2-ethylhexanol.

Preferred (meth)acrylic esters (Dc) are (meth)acrylic esters of $C_5$- to $C_{12}$-alkanols, preferably of n-pentanol, n-hexanol, n-heptanol, n-octanol, n-decanol, n-dodecanol (lauryl alcohol), 2-ethylhexanol or 2-propylheptanol. Particular preference is given to pentyl acrylate, 2-ethylhexyl acrylate, 2-propylheptyl acrylate.

Examples of monomers (Dd) are allyl alcohols and allyl ethers of $C_2$- to $C_{12}$-alkanols, preferably allyl ethers of methanol, ethanol, iso-propanol, n-propenol, n-butanol, iso-butanol, sec-butanol, tert-butanol, n-hexanol, n-heptanol, n-octanol, n-decanol, n-dodecanol (lauryl alcohol) or 2-ethylhexanol.

Examples of vinyl compounds (De) of heterocycles comprising at least one nitrogen atom are N-vinylpyridine, N-vinylimidazole and N-vinylmorpholine.

Preferred compounds (De) are N-vinylamides or N-vinyllactams.

Examples of N-vinylamides or N-vinyllactams (De) are N-vinylformamide, N-vinylacetamide, N-vinylpyrrolidone and N-vinylcaprolactam.

Examples of ethylenically unsaturated aromatics (Df) are styrene and α-methylstyrene.

Examples of α,β-ethylenically unsaturated nitriles (Dg) are acrylonitrile and methacrylonitrile.

Examples of (meth)acrylamides (Dh) are acrylamide and methacrylamide.

Examples of allylamines (Di) are allylamine, dialkylallylamine and trialkylallylammonium halides.

Preferred monomers (D) are (Da), (Db), (Dc), (De) and/or (Df), more preferably (Da), (Db) and/or (Dc), even more preferably (Da) and/or (Dc) and especially (Dc).

The incorporation ratio of the monomers (A) and (B) and optionally (C) and optionally (D) in the copolymer obtained from reaction step (I) is generally as follows:

The molar ratio of (A)/((B) and (C)) (in total) is generally from 10:1 to 1:10, preferably 8:1 to 1:8, more preferably 5:1 to 1:5, even more preferably 3:1 to 1:3, particularly 2:1 to 1:2 and especially 1.5:1 to 1:1.5. In the particular case of maleic anhydride as monomer (A), the molar incorporation ratio of maleic anhydride to monomers ((B) and (C)) (in total) (in total) is about 1:1. In order to achieve complete conversion of the α-olefin (B), it may nevertheless be advisable to use maleic anhydride in a slight excess over the α-olefin, for example 1.01-1.5:1, preferably 1.02-1.4:1, more preferably 1.05-1.3:1, even more preferably 1.07-1.2:1 and especially 1.1-1.15:1.

The molar ratio of obligatory monomer (B) to monomer (C), if present, is generally of 1:0.05 to 10, preferably of 1:0.1 to 6, more preferably of 1:0.2 to 4, even more preferably of 1:0.3 to 2.5 and especially 1:0.5 to 1.5.

In a preferred embodiment, no optional monomer (C) is present in addition to monomer (B).

The proportion of one or more of the monomers (D), if present, based on the amount of the monomers (A), (B) and optionally (C) (in total) is generally 5 to 200 mol %, preferably 10 to 150 mol %, more preferably 15 to 100 mol %, even more preferably 20 to 50 mol % and especially 0 to 25 mol %.

In a preferred embodiment, no optional monomer (D) is present.

In a particularly preferred embodiment, the copolymer consists of monomers (A) and (B).

In a second optional reaction step (II), the anhydride or carboxylic ester functionalities present in the copolymer obtained from (I) may be partly hydrolyzed end/or saponified. Preferably, in reaction step (II), anhydride functionalities are hydrolyzed and carboxylic ester functionalities are left essentially intact.

According to the invention, more than 90% of the anhydride and carboxylic ester functionalities present remain intact after reaction step (II), preferably at least 92%, more preferably at least 94%, even more preferably at least 95%, particularly at least 97% and especially at least 98%.

It is possible that up to 99.9% of the anhydride and carboxylic ester functionalities present remain intact after reaction step (II), preferably up to 99.8%, more preferably up to 99.7%, even more preferably up to 99.5% and especially up to 99%.

In a preferred embodiment, reaction step (11) is not conducted, and so 100% of the anhydride and carboxylic ester functionalities present in the copolymer obtained from reaction step (I), particularly of the anhydride functionalities present, remain intact.

A hydrolysis in reaction step (II) is conducted when the derivative of monomer (A) used is an anhydride, preferably the anhydride of a dicarboxylic acid, whereas a saponification or hydrolysis can be conducted when an ester is used as monomer (A).

For a hydrolysis, based on the anhydride functionalities present, the amount of water that corresponds to the desired hydrolysis level is added and the copolymer obtained from (I) is heated in the presence of the added water. In general, a temperature of preferably 20 to 150° C. is sufficient for the purpose, preferably 60 to 100° C. If required, the reaction can be conducted under pressure in order to prevent the escape of water. Under these reaction conditions, in general, the anhydride functionalities in the copolymer are converted selectively, whereas any carboxylic ester functionalities present in the copolymer react at least only to a minor degree, if at all.

For a saponification, the copolymer is reacted with an amount of a strong base corresponding to the desired saponification level in the presence of water.

Strong bases used may preferably be hydroxides, oxides, carbonates or hydrogencarbonates of alkali metals or alkaline earth metals.

The copolymer obtained from (I) is then heated in the presence of the added water and the strong base. In general, a temperature of preferably 20 to 130° C. is sufficient for the purpose, preferably 50 to 110° C. If required, the reaction can be conducted under pressure.

It is also possible to hydrolyze the carboxylic ester functionalities with water in the presence of an acid. Acids used are preferably mineral acids, carboxylic acids, sulfonic acids or phosphorus acids having a pKa of not more than 5, more preferably not more than 4.

Examples are acetic acid, formic acid, acid, salicylic acid, substituted succinic acids, aromatically substituted or unsubstituted benzenesulfonic acids, sulfuric acid, nitric acid, hydrochloric acid or phosphoric acid; the use of acidic ion exchange resins is also conceivable.

The copolymer obtained from (I) is then heated in the presence of the added water and the acid. In general, a temperature of preferably 40 to 200° C. is sufficient for the purpose, preferably 80 to 150° C. If required, the reaction can be conducted under pressure.

Should the copolymers obtained from step (II) still comprise residues of acid anions, it may be preferable to remove these acid anions from the copolymer with the aid of an ion exchanger and preferably exchange them for hydroxide ions or carboxylate ions, more preferably hydroxide ions. This is the case especially when the acid anions present in the copolymer are halides or contain sulfur or nitrogen.

The copolymer obtained from reaction step (II) generally has a weight-average molecular weight Mw of 0.5 to 20 kDa, preferably 0.6 to 15, more preferably 0.7 to 7, even more preferably 1 to 7 and especially 1.5 to 54 kDa (determined by gel permeation chromatography with tetrahydrofuran and polystyrene as standard).

The number-average molecular weight Mn is usually from 0.5 to 10 kDa, preferably 0.6 to 5, more preferably 0.7 to 4, even more preferably 0.8 to 3 and especially 1 to 2 kDa (determined by gel permeation chromatography with tetrahydrofuran and polystyrene as standard).

The polydispersity is generally from 1 to 10, preferably from 1.1 to 8, more preferably from 1.2 to 7, even more preferably from 1.3 to 5 and especially from 1.5 to 3.

The content of free acid groups in the copolymer after conducting reaction step (II) is preferably less than 5 mmol/g of copolymer, more preferably less than 3, even more preferably less than 2 mmol/g of copolymer and especially less than 1 mmol/g.

In a preferred embodiment, the copolymers comprise a high proportion of adjacent carboxylic acid groups, which is determined by a measurement of adjacency. For this purpose, a sample of the copolymer is heat-treated between two Teflon films at a temperature of 290° C. for a period of 30 minutes and an FTIR spectrum is recorded at a bubble-free site. The IR spectrum of Teflon is subtracted from the spectra obtained, the layer thickness is determined and the content of cyclic anhydride is determined.

In a preferred embodiment, the adjacency is at least 10%, preferably at least 15%, more preferably at least 20%, even more preferably at least 25% and especially at least 30%.

Use

The fuel additized with the inventive copolymer is a gasoline fuel or more particularly a middle distillate fuel, in particular a diesel fuel.

The fuel may comprise further customary additives to improve efficacy and/or suppress wear.

Frequently, the copolymers described are used in the form of fuel additive mixtures, together with customary additives:

In the case of diesel fuels, these are primarily customary detergent additives, carrier oils, cold flow improvers, lubricity improvers, corrosion inhibitors other than the copolymers described, demulsifiers, dehazers, antifoams, cetane number improvers, combustion improvers, antioxidants or stabilizers, antistats, metallocenes, metal deactivators, dyes and/or solvents.

Accordingly, the invention further provides for the use of copolymers obtainable by in a first reaction step (I) copolymerizing (A) at least one ethylenically unsaturated mono- or dicarboxylic acid or derivatives thereof, preferably a dicarboxylic acid or derivatives thereof, more preferably the anhydride of a dicarboxylic acid, (B) at least one α-olefin having from at least 12 up to and including 30 carbon atoms, (C) optionally at least one further aliphatic or cycloaliphatic olefin which has at least 4 carbon atoms and is different than (B) and (D) optionally one or more further copolymerizable monomers other than monomers (A), (B) and (C), selected from the group consisting of (Da) vinyl esters, (Db) vinyl ethers, (Dc) (meth)acrylic esters of alcohols having at least 5 carbon atoms.

(Dd) allyl alcohols or ethers thereof, (De) N-vinyl compounds selected from the group consisting of vinyl compounds of heterocycles containing at least one nitrogen atom, N-vinylamides or N-vinyllactams, (Df) ethylenically unsaturated aromatics, (Dg) α,β-ethylenically unsaturated nitriles.

(Dh) (meth)acrylamides and (Di) allylamines, followed by in a second optional reaction step (II) partly hydrolyzing the anhydride functionalities present in the copolymer obtained from (I) and/or partly hydrolyzing carboxylic ester functionalities present in the copolymer obtained from (I), with the proviso that more than 90% of the anhydride and carboxylic ester functionalities present remain intact after reaction step (II), in additive packages comprising at least one additive selected from the group consisting of detergent additives, carrier oils, cold flow improvers, lubricity improvers, corrosion inhibitors other than the copolymers described, demulsifiers, dehazers, antifoams, cetane number improvers, combustion improvers, antioxidants, stabilizers, antistats, metallocenes, metal deactivators, dyes and solvents, for reducing the fuel consumption of direct injection diesel engines, especially of diesel engines with common rail injection systems, and/or for minimizing power loss in direct injection diesel engines, especially in diesel engines with common rail injection systems.

In the case of gasoline fuels, these are in particular lubricity improvers (friction modifiers), corrosion inhibitors other than the copolymers described, demulsifiers, dehazers, antifoams, combustion improvers, antioxidants or stabilizers, antistats, metallocenes, metal deactivators, dyes and/or solvents.

Accordingly, the invention further provides for the use of copolymers obtainable by in a first reaction step (I) copolymerizing (A) at least one ethylenically unsaturated mono- or dicarboxylic acid or derivatives thereof, preferably a dicarboxylic acid or derivatives thereof, more preferably the anhydride of a dicarboxylic acid, (B) at least one α-olefin having from at least 12 up to and including 30 carbon atoms, (C) optionally at least one further aliphatic or cycloaliphatic olefin which has at least 4 carbon atoms and is different than (B) and (D) optionally one or more further copolymerizable monomers other than monomers (A), (B) and (C), selected from the group consisting of (Da) vinyl esters, (Db) vinyl ethers, (Dc) (meth)acrylic esters of alcohols having at least 5 carbon atoms, (Dd) allyl alcohols or ethers thereof, (De) N-vinyl compounds selected from the group consisting of vinyl compounds of heterocycles containing at least one nitrogen atom, N-vinylamides or N-vinyllactams, (Df) ethylenically unsaturated aromatics, (Dg) α,β-ethylenically unsaturated nitriles, (Dh) (meth)acrylamides and (Di) allylamines, followed by in a second optional reaction step (II) partly hydrolyzing the anhydride functionalities present in the copolymer obtained from (I) and/or partly hydrolyzing carboxylic ester functionalities present in the copolymer obtained from (I), with the proviso that more than 90% of the anhydride and carboxylic ester functionalities present remain intact after reaction step (II), in additive packages comprising at least one additive selected from the group consisting of lubricity improvers (friction modifiers), corrosion inhibitors other than the copolymers described, demulsifiers, dehazers, antifoams, combustion improvers, antioxidants, stabilizers, antistats, metallocenes, metal deactivators, dyes and solvents, for reducing the level of deposits in the intake system of a gasoline engine, such as, more particularly, DISI and PFI (port fuel injector) engines.

Typical examples of suitable coadditives are listed in the following section:

B1) DETERGENT ADDITIVES

The customary detergent additives are preferably amphiphilic substances which possess at least one hydrophobic hydrocarbon radical with a number-average molecular weight ($M_n$) of 85 to 20 000 and at least one polar moiety selected from:

(Da) mono- or polyamino groups having up to 6 nitrogen atoms, at least one nitrogen atom having basic properties;

(Db) nitro groups, optionally in combination with hydroxyl groups;

(Dc) hydroxyl groups in combination with mono- or polyamino groups, at least one nitrogen atom having basic properties;

(Dd) carboxyl groups or the alkali metal or alkaline earth metal salts thereof;

(De) sulfonic acid groups or the alkali metal or alkaline earth metal salts thereof;

(Df) polyoxy-$C_2$- to $C_4$-alkylene moieties terminated by hydroxyl groups, mono- or polyamino groups, at least one nitrogen atom having basic properties, or by carbamate groups;

(Dg) carboxylic ester groups;

(Dh) moieties derived from succinic anhydride and having hydroxyl and/or amino and/or amido and/or imido groups; and/or (Di) moieties obtained by Mannich reaction of substituted phenols with aldehydes and mono- or polyamines.

The hydrophobic hydrocarbon radical in the above detergent additives, which ensures the adequate solubility in the fuel, has a number-average molecular weight ($M_n$) of 85 to 20 000, preferably of 113 to 10 000, more preferably of 300 to 5000, even more preferably of 300 to 3000, even more especially preferably of 500 to 2500 and especially of 700 to 2500, in particular of 800 to 1500. As typical hydrophobic hydrocarbon radicals, especially in conjunction with the polar, especially polypropenyl, polybutanyl and polyisobutenyl radicals with a number-average molecular weight $M_n$ of preferably in each case 300 to 5000, more preferably 300 to 3000, even more preferably 500 to 2500, even more especially preferably 700 to 2500 and especially 800 to 1500 into consideration.

Examples of the above groups of detergent additives include the following:

Additives comprising mono- or polyamino groups (Da) are preferably polyalkenemono- or polyalkenepolyamines based on polypropene or on high-reactivity (i.e. having predominantly terminal double bonds) or conventional (i.e. having predominantly internal double bonds) polybutene or polyisobutene with $M_n$=300 to 5000, more preferably 500 to 2500 and especially 700 to 2500. Such additives based on high-reactivity polyisobutene, which can be prepared from the polyisobutene which may comprise up to 20% by weight of n-butene units by hydroformylation and reductive amination with ammonia, monoamines or polyamines such as dimethylaminopropylamine, ethylenediamine, diethylenetriamine, triethylenetetramine or tetraethylenepentamine, are known especially from EP-A 244 616. When polybutene or polyisobutene having predominantly internal double bonds (usually in the β and γ positions) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or the abovementioned polyamines. Corresponding additives based on polypropene are described more particularly in WO-A 94/24231.

Further particular additives comprising monoamino groups (Da) are the hydrogenation products of the reaction products of polyisobutenes having an average degree of polymerization P=5 to 100 with nitrogen oxides or mixtures of nitrogen oxides and oxygen, as described more particularly in WO-A 97/03946.

Further particular additives comprising monoamino groups (Da) are the compounds obtainable from polyisobutene epoxides by reaction with amines and subsequent dehydration and reduction of the amino alcohols, as described more particularly in DE-A 196 20 262.

Additives comprising nitro groups (Db), optionally in combination with hydroxyl groups, are preferably reaction products of polyisobutenes having an average degree of polymerization P=5 to 100 or 10 to 100 with nitrogen oxides or mixtures of nitrogen oxides and oxygen, as described more particularly in WO-A 96/03367 and in WO-A 96/03479. These reaction products are generally mixtures of pure nitropolyisobutenes (e.g. α,β-dinitropolyisobutene) and mixed hydroxynitropolyisobutenes (e.g. α-nitro-β-hydroxypolyisobutene).

Additives comprising hydroxyl groups in combination with mono- or polyamino groups (Dc) are especially reaction products of polyisobutene epoxides obtainable from polyisobutene having preferably predominantly terminal double bonds and $M_n$=300 to 5000, with ammonia or mono- or polyamines, as described more particularly in EP-A 476 485.

Additives comprising carboxyl groups or their alkali metal or alkaline earth metal salts (Dd) are preferably copolymers of $C_2$- to $C_{40}$-olefins with maleic anhydride which have a total molar mass of 500 to 20 000 and wherein some or all of the carboxyl groups have been converted to the alkali metal or alkaline earth metal salts and any remainder of the carboxyl groups has been reacted with alcohols or amines. Such additives are disclosed more particularly by EP-A 307 815. Such additives serve mainly to prevent valve seat wear and can, as described in WO-A 87/01126, advantageously be used in combination with customary fuel detergents such as poly(iso)buteneamines or polyetheramines.

Additives comprising sulfonic acid groups or their alkali metal or alkaline earth metal salts (De) are preferably alkali metal or alkaline earth metal salts of an alkyl sulfosuccinate, as described more particularly in EP-A 639 632. Such additives serve mainly to prevent valve seat wear and can be used advantageously in combination with customary fuel detergents such as poly(iso)buteneamines or polyetheramines.

Additives comprising polyoxy-$C_2$-$C_4$-alkylene moieties (Df) are preferably polyethers or polyetheramines which are obtainable by reaction of $C_2$- to $C_{60}$-alkanols. $C_6$- to $C_{30}$-alkanediols, mono- or di-$C_2$- to $C_{30}$-alkylamines, $C_1$- to $C_{30}$-alkylcyclohexanols or $C_1$- to $C_{30}$-alkylphenols with 1 to 30 mol of ethylene oxide and/or propylene oxide and/or butylene oxide per hydroxyl group or amino group and, in the case of the polyatheramines, by subsequent reductive amination with ammonia, monoamines or polyamines. Such products are described more particularly in EP-A 310 875, EP-A 356 725, EP-A 700 985 and U.S. Pat. No. 4,877,416. In the case of polyethers, such products also have carrier oil properties. Typical examples thereof are tridecanol butoxylates or isotridecanol butoxylates, isononylphenol butoxylates and also polyisobutenol butoxylates and propoxylates, and also the corresponding reaction products with ammonia.

Additives comprising carboxylic ester groups (Dg) are preferably esters of mono-, di- or tricarboxylic acids with long-chain alkanols or polyols, especially those having a minimum viscosity of 2 $mm^2/s$ at 100° C., as described more particularly in DE-A 38 38 918. The mono-, di- or tricarboxylic acids used may be aliphatic or aromatic acids, and particularly suitable ester alcohols or ester polyols are long-chain representatives having, for example, 6 to 24 carbon atoms. Typical representatives of the esters are adipates, phthalates, isophthalates, terephthalates and trimellitates of isoodanol, of isononanol, of isodecanol and of isotridecanol. Such products also satisfy carrier oil properties.

Additives comprising moieties derived from succinic anhydride and having hydroxyl and/or amino and/or amido and/or especially imido groups (Dh) are preferably corresponding derivatives of alkyl- or alkenyl-substituted succinic anhydride and especially the corresponding derivatives of polyisobutanylsuccinic anhydride which are obtainable by reacting conventional or high-reactivity polyisobutene having $M_n$=preferably 300 to 5000, more preferably 300 to 3000, even more preferably 500 to 2500, even more especially preferably 700 to 2500 and especially 800 to 1500, with maleic anhydride by a thermal route in an ene reaction or via the chlorinated polyisobutene. The moieties having hydroxyl and/or amino and/or amido and/or imido groups are, for example, carboxylic acid groups, acid amides of monoamines, acid amides of di- or polyamines which, in addition to the amide function, also have free amine groups, succinic acid derivatives having an acid and an amide function, carboximides with monoamines, carboximides with di- or polyamines which, in addition to the imide function, also have free amine groups, or diimides which are formed by the reaction of di- or polyamines with two succinic acid derivatives. Such fuel additives are common knowledge and are described, for example, in documents (1) and (2). They are preferably the reaction products of alkyl- or alkenyl-substituted succinic acids or derivatives thereof with amines and more preferably the reaction products of polyisobutenyl-substituted succinic acids or derivatives thereof with amines. Of particular interest in this context are reaction products with aliphatic polyamines (polyalkyleneimines) such as, more particularly, ethylenediamine, diethylenetriamine, triethylenetetramine, tetreethylenepentamine, pentaethylenehexamine and hexaethyleneheptamine, which have an imide structure.

In a preferred embodiment, the inventive compounds may be combined with quaternized compounds as described in WO 2012/004300, preferably at page 5 line 18 to page 33 line 5 thereof, more preferably preparation example 1, which is hereby explicitly incorporated into the present disclosure by way of reference.

In a further preferred embodiment, the inventive compounds may be combined with quaternized compounds as described in unpublished International Application PCT/EP2014/061834, filed Jun. 6, 2014, preferably at page 5 line 21 to page 47 line 34 thereof, more preferably preparation examples 1 to 17.

In a further preferred embodiment, the inventive compounds may be combined with quaternized compounds as described in WO 11/95819 A1, preferably at page 4 line 5 to page 13 line 26 thereof, more preferably preparation example 2.

In a further preferred embodiment, the inventive compounds may be combined with quaternized compounds as described in WO 11/110860 A1, preferably at page 4 line 7 to page 16 line 26 thereof, more preferably preparation examples 8, 9, 11 and 13.

In a further preferred embodiment, the inventive compounds may be combined with quaternized compounds as described in WO 06/135881 A2, preferably at page 5 line 14 to page 12 line 14 thereof, more preferably examples 1 to 4.

In a further preferred embodiment, the inventive compounds may be combined with quaternized compounds as described in WO 10/132259 A1, preferably at page 3 line 29 to page 10 line 21 thereof, more preferably example 3.

In a further preferred embodiment, the inventive compounds may be combined with quaternized compounds as described in WO 08/060888 A2, preferably at page 6 line 15 to page 14 line 29 thereof, more preferably examples 1 to 4.

In a further preferred embodiment, the inventive compounds may be combined with quaternized compounds as described in GB 2496514 A, preferably at paragraphs [00012] to [00039] thereof, more preferably examples 1 to 3.

In a further preferred embodiment, the inventive compounds may be combined with quaternized compounds as described in WO 2013 070503 A1, preferably at paragraphs [00011] to [00039] thereof, more preferably examples 1 to 5.

Additives comprising moieties (Di) obtained by Mannich reaction of substituted phenols with aldehydes and mono- or polyamines are preferably reaction products of polyisobutene-substituted phenols with formaldehyde and mono- or polyamines such as ethylenediamine, diethylenetriamine, triethylenetetramine, tetraethylenepentamine or dimethylaminopropylamine.

The polyisobutenyl-substituted phenols may originate from conventional or high-reactivity polyisobutene having $M_n$=300 to 5000. Such "polyisobutene Mannich bases" are described more particularly in EP-A 831 141.

One or more of the detergent additives mentioned can be added to the fuel in such an amount that the dosage rate of these detergent additives is preferably 25 to 2500 ppm by weight, especially 75 to 1500 ppm by weight, in particular 150 to 1000 ppm by weight.

B2) CARRIER OILS

Carrier oils additionally used may be of mineral or synthetic nature. Suitable mineral carrier oils are fractions obtained in crude oil processing, such as brightatock or base oils having viscosities, for example, from the SN 500-2000 class; but also aromatic hydrocarbons, paraffinic hydrocarbons and alkoxyalkanols. Likewise useful is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized). Likewise suitable are mixtures of the abovementioned mineral carrier oils.

Examples of suitable synthetic carrier oils are polyolefins (polyalphaolefins or polyintemalolefins), (poly)esters, (poly)alkoxylates, polyethers, aliphatic polyether-amines, alkylphenol-started polyethers, alkylphenol-started polyetheramines and carboxylic esters of long-chain alkanols.

Examples of suitable polyolefins are olefin polymers having $M_n$=400 to 1800, in particular based on polybutene or polyisobutene (hydrogenated or unhydrogenated).

Examples of suitable polyethers or polyetheramines are preferably compounds comprising polyoxy-$C_2$- to $C_4$-alkylene moieties obtainable by reacting $C_2$- to $C_{60}$-alkanols, $C_6$- to $C_{30}$-alkanediols, mono- or di-$C_2$- to $C_{30}$-alkylamines, $C_1$- to $C_{30}$-alkylcyclohexanols or $C_1$- to $C_{30}$-alkylphenols with 1 to 30 mol of ethylene oxide and/or propylene oxide and/or butylene oxide per hydroxyl group or amino group, and, in the case of the polyetheramines, by subsequent reductive amination with ammonia, monoamines or polyamines. Such products are described more particularly in EP-A 310 875, EP-A 356 725, EP-A 700 985 and U.S. Pat. No. 4,877,416. For example, the polyetheramines used may be poly-$C_2$- to $C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are more particularly esters of mono-, di- or tricarboxylic acids with long-chain alkanols or polyols, as described more particularly in DE-A 38 38 918. The mono-, di- or tricarboxylic acids used may be aliphatic or aromatic acids; particularly suitable ester alcohols or ester polyols are long-chain representatives having, for example, 6 to 24 carbon atoms. Typical representatives of the esters are adipates, phthalates, isophthalates, terephthalates and trimellitates of isooctanol, isononanol, isodecanol and isotridecanol, for example di(n- or isotridecyl) phthalate.

Further suitable carrier oil systems are described, for example, in DE-A 38 26 608, DE-A 41 42 241, DE-A 43 09 074, EP-A 452 328 and EP-A 548 617.

Examples of particularly suitable synthetic carrier oils are alcohol-started polyethers having about 5 to 35, preferably about 5 to 30, more preferably 10 to 30 and especially 15 to 30 $C_3$- to $C_6$-alkylene oxide units, for example propylene oxide, n-butylene oxide and isobutylene oxide units, or mixtures thereof, per alcohol molecule. Nonlimiting examples of suitable starter alcohols are long-chain alkanols or phenols substituted by long-chain alkyl in which the long-chain alkyl radical is especially a straight-chain or branched $C_6$- to $C_{18}$-alkyl radical. Particular examples include tridecanol and nonylphenol. Particularly preferred alcohol-started polyethers are the reaction products (polyetherification products) of monohydric aliphatic $C_6$- to $C_{18}$-alcohols with $C_3$- to $C_6$-alkylene oxides. Examples of monohydric aliphatic $C_6$-$C_{18}$-alcohols are hexanol, heptanol, octanol, 2-ethylhexanol, nonyl alcohol, decanol, 3-propylheptanol, undecanol, dodecanol, tridecanol, tetradecanol, pentadecanol, hexadecanol, octadecanol and the constitutional and positional isomers thereof. The alcohols can be used either in the form of the pure isomers or in the form of technical grade mixtures. A particularly preferred alcohol is tridecanol. Examples of $C_3$- to $C_6$-alkylene oxides are propylene oxide, such as 1,2-propylene oxide, butylene oxide, such as 1,2-butylene oxide, 2,3-butylene oxide, isobutylene oxide or tetrahydrofuran, pentylene oxide and hexylene oxide. Particular preference among these is given to $C_3$- to $C_4$-alkylene oxides, i.e. propylene oxide such as 1,2-propylene oxide and butylene oxide such as 1,2-butylene oxide, 2,3-butylene oxide and isobutylene oxide. Especially butylene oxide is used.

Further suitable synthetic carrier oils are alkoxylated alkylphenols, as described in DE-A 10 102 913.

Particular carrier oils are synthetic carrier oils, particular preference being given to the above-described alcohol-started polyethers.

The carrier oil or the mixture of different carrier oils is added to the fuel in an amount of preferably 1 to 1000 ppm by weight, more preferably of 10 to 500 ppm by weight and especially of 20 to 100 ppm by weight.

B3) COLD FLOW IMPROVERS

Suitable cold flow improvers are in principle all organic compounds which are capable of improving the flow performance of middle distillate fuels or diesel fuels under cold conditions. For the intended purpose, they must have sufficient oil solubility. More particularly, useful cold flow improvers for this purpose are the cold flow improvers (middle distillate flow improvers, MDFIs) typically used in the case of middle distillates of fossil origin, i.e. in the case of customary mineral diesel fuels. However, it is also possible to use organic compounds which partly or predominantly have the properties of a wax antisettling additive (WASA) when used in customary diesel fuels. They can also act partly or predominantly as nucleators. It is also possible to use mixtures of organic compounds effective as MDFIs and/or effective as WASAs and/or effective as nucleators.

The cold flow improver is typically selected from:

(K1) copolymers of a $C_2$- to $C_{40}$-olefin with at least one further ethylenically unsaturated monomer;

(K2) comb polymers;

(K3) polyoxyalkylenes;

(K4) polar nitrogen compounds;

(K5) sulfocarboxylic acids or sulfonic acids or derivatives thereof; and (K6) poly(meth)acrylic esters.

It is possible to use either mixtures of different representatives from one of the particular classes (K1) to (K6) or mixtures of representatives from different classes (K1) to (K6).

Suitable $C_2$- to $C_{40}$-olefin monomers for the copolymers of class (K1) are, for example, those having 2 to 20 and especially 2 to 10 carbon atoms, and 1 to 3 and preferably 1 or 2 carbon-carbon double bonds, especially having one carbon-carbon double bond. In the latter case, the carbon-carbon double bond may be arranged either terminally (α-olefins) or internally. However, preference is given to α-olefins, particular preference to α-define having 2 to 6 carbon atoms, for example propene, 1-butene, 1-pentene, 1-hexene and in particular ethylene.

In the copolymers of class (K1), the at least one further ethylenically unsaturated monomer is preferably selected from alkenyl carboxylates, (meth)acrylic esters and further olefins.

When further olefins are also copolymerized, they are preferably higher in molecular weight than the abovementioned $C_2$- to $C_{40}$-olefin base monomers. When, for example, the olefin base monomer used is ethylene or propene, suitable further olefins are especially $C_{10}$- to $C_{40}$-α-olefins. Further olefins are in most cases only additionally copolymerized when monomers with carboxylic ester functions are also used.

Suitable (meth)acrylic esters are, for example, esters of (meth)acrylic acid with $C_1$- to C20-alkanols, especially $C_1$- to $C_{10}$-alkanols, in particular with methanol, ethanol, propanol, isopropanol, n-butanol, sec-butanol, isobutanol, tert-butanol, pentanol, hexanol, heptanol, octanol, 2-ethylhexanol, nonanol and decanol, and structural isomers thereof.

Suitable alkenyl carboxylates are, for example, $C_2$- to $C_{14}$-alkenyl esters, for example the vinyl and propenyl esters, of carboxylic acids having 2 to 21 carbon atoms, whose hydrocarbyl radical may be linear or branched. Among these, preference is given to the vinyl esters. Among the carboxylic acids with a branched hydrocarbyl radical, preference is given to those whose branch is in the α position to the carboxyl group, and the α-carbon atom is more preferably tertiary, i.e. the carboxylic acid is what is called a neocarboxylic acid. However, the hydrocarbyl radical of the carboxylic acid is preferably linear.

Examples of suitable alkenyl carboxylates are vinyl acetate, vinyl propionate, vinyl butyrate, vinyl 2-ethylhexanoate, vinyl neopentanoete, vinyl hexanoate, vinyl neononanoete, vinyl neodecanoate and the corresponding propenyl esters, preference being given to the vinyl esters. A particularly preferred alkenyl carboxylate is vinyl acetate; typical copolymers of group (K1) resulting therefrom are ethylene-vinyl acetate copolymers ("EVAs"), which are some of the most frequently used.

Ethylene-vinyl acetate copolymers usable particularly advantageously and the preparation thereof are described in WO 99/29748.

Suitable copolymers of class (K1) are also those which comprise two or more different alkenyl carboxylates in copolymerized form, which differ in the alkenyl function end/or in the carboxylic acid group. Likewise suitable are copolymers which, as well as the alkenyl carboxylate(s), comprise at least one olefin and/or at least one (meth)acrylic ester in copolymerized form.

Terpolymers of a $C_2$- to $C_{40}$-α-olefin, a $C_1$- to $C_{20}$-alkyl ester of an ethylenically unsaturated monocarboxylic acid having 3 to 15 carbon atoms and a $C_2$- to $C_{14}$-alkenyl ester of a saturated monocarboxylic acid having 2 to 21 carbon atoms are also suitable as copolymers of class (K1). Terpolymers of this kind are described in WO 2005/054314. A typical terpolymer of this kind is formed from ethylene, 2-ethylhexyl acrylate and vinyl acetate.

The at least one or the further ethylenically unsaturated monomer(s) are copolymerized in the copolymers of class (K1) in an amount of preferably 1 to 50% by weight, especially 10 to 45% by weight and in particular 20 to 40% by weight, based on the overall copolymer. The main proportion in terms of weight of the monomer units in the copolymers of class (K1) therefore originates generally from the $C_2$- to $C_{40}$ base olefins.

The copolymers of class (K1) preferably have a number-average molecular weight $M_n$ of 1000 to 20 000, more preferably of 1000 to 10 000 and especially of 1000 to 8000.

Typical comb polymers of component (K2) are, for example, obtainable by the copolymerization of maleic anhydride or fumaric acid with another ethylenically unsaturated monomer, for example with an α-olefin or an unsaturated ester, such as vinyl acetate, and subsequent esterification of the anhydride or acid function with an alcohol having at least 10 carbon atoms. Further suitable comb polymers are copolymers of α-olefins and esterified comonomers, for example esterified copolymers of styrene and maleic anhydride or esterifed copolymers of styrene and fumaric acid. Suitable comb polymers may also be polyfumarates or polymaleates. Homo- and copolymers of vinyl ethers are also suitable comb polymers. Comb polymers suitable as components of class (K2) are, for example, also those described in WO 2004/035715 and in "Comb-Like Polymers, Structure and Properties", N. A. Platé and V. P. Shibaev, J. Poly. Sci. Macromolecular Revs. 8, pages 117 to 253 (1974). Mixtures of comb polymers are also suitable.

Polyoxyalkylenes suitable as components of class (K3) are, for example, polyoxyalkylene esters, polyoxyalkylene ethers, mixed polyoxyalkylene ester/ethers and mixtures thereof. These polyoxyalkylene compounds preferably comprise at least one linear alkyl group, preferably at least two linear alkyl groups, each having 10 to 30 carbon atoms and a polyoxyalkylene group having a number-average molecular weight of up to 5000. Such polyoxyalkylene compounds are described, for example, in EP-A 061 895 and also in U.S. Pat. No. 4,491,455. Particular polyoxyalkylene compounds are based on polyethylene glycols and polypropylene glycols having a number-average molecular weight of 100 to 5000. Additionally suitable are polyoxyalkylene mono- and diesters of fatty acids having 10 to 30 carbon atoms, such as stearic acid or behenic acid.

Polar nitrogen compounds suitable as components of class (K4) may be either ionic or nonionic and preferably have at least one substituent, especially at least two substituents, in the form of a tertiary nitrogen atom of the general formula $>NR^7$ in which $R^7$ is a $C_8$- to $C_{40}$-hydrocarbyl radical. The nitrogen substituents may also be quaternized, i.e. be in cationic form. Examples of such nitrogen compounds are ammonium salts and/or amides which are obtainable by the reaction of at least one amine substituted by at least one hydrocarbyl radical with a carboxylic acid having 1 to 4 carboxyl groups or with a suitable derivative thereof. The amines preferably comprise at least one linear $C_8$- to $C_{40}$-alkyl radical. Primary amines suitable for preparing the polar nitrogen compounds mentioned are, for example, octylamine, nonylamine, decylamine, undecylamine, dodecylamine, tetradecylamine and the higher linear homologs; secondary amines suitable for this purpose are, for example, dioctadecylamine and methylbehenylamine. Also suitable for this purpose are amine mixtures, especially amine mixtures obtainable on the industrial scale, such as fatty amines or hydrogenated tallamines, as described, for example, in Ullmann's Encyclopedia of Industrial Chemistry, 6th Edition. "Amines, aliphatic" chapter. Acids suitable for the reaction are, for example, cyclohexane-1,2-dicarboxylic acid, cyclohexene-1,2-dicarboxylic acid, cyclopentene-1,2-dicarboxylic acid, naphthalenedicarboxylic acid, phthalic acid, isophthalic acid, terephthalic acid, and succinic acids substituted by long-chain hydrocarbyl radicals.

More particularly, the component of class (K4) is an oil-soluble reaction product of poly($C_2$- to $C_{20}$-carboxylic acids) having at least one tertiary amino group with primary or secondary amines. The poly($C_2$- to $C_{20}$-carboxylic acids) which have at least one tertiary amino group and form the basis of this reaction product comprise preferably at least 3 carboxyl groups, especially 3 to 12 and in particular 3 to 5 carboxyl groups. The carboxylic acid units in the polycarboxylic acids have preferably 2 to 10 carbon atoms, and are especially acetic acid units. The carboxylic acid units are suitably bonded to the polycarboxylic acids, usually via one or more carbon and/or nitrogen atoms. They are preferably attached to tertiary nitrogen atoms which, in the case of a plurality of nitrogen atoms, are bonded via hydrocarbon chains.

The component of class (K4) is preferably an oil-soluble reaction product based on poly($C_2$- to $C_{20}$-carboxylic acids) which have at least one tertiary amino group and are of the general formula IIa or IIb (IIa)

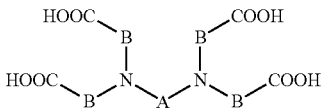

(IIb)

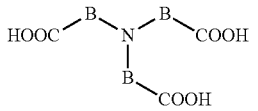

in which the variable A is a straight-chain or branched $C_2$- to $C_6$-alkylene group or the moiety of the formula III (III)

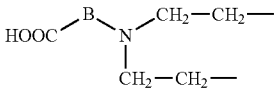

and the variable B is a $C_1$- to $C_{19}$-alkylene group. The compounds of the general formulae IIa and IIb especially have the properties of a WASA.

Moreover, the preferred oil-soluble reaction product of component (K4), especially that of the general formula IIa or IIb, is an amide, an amide-ammonium salt or an ammonium salt in which no, one or more carboxylic acid groups have been converted to amide groups.

Straight-chain or branched $C_2$- to $C_6$-alkylene groups of the variable A are, for example, 1,1-ethylene, 1,2-propylene, 1,3-propylene, 1,2-butylene, 1,3-butylene, 1,4-butylene, 2-methyl-1,3-propylene, 1,5-pentylene, 2-methyl-1,4-butylene, 2,2-dimethyl-1,3-propylene, 1,6-hexylene (hexamethylene) and especially 1,2-ethylene. The variable A comprises preferably 2 to 4 and especially 2 or 3 carbon atoms.

$C_1$- to $C_{19}$-alkylene groups of the variable B are, for example, 1,2-ethylene, 1,3-propylene, 1,4-butylene, hexamethylene, octamethylene, decamethylene, dodecamethylene, tetradecamethylene, hexadecamethylene, octadecamethylene, nonadecamethylene and especially methylene. The variable B comprises preferably 1 to 10 and especially 1 to 4 carbon atoms.

The primary and secondary amines as a reaction partner for the polycarboxylic acids to form component (K4) are typically monoamines, especially aliphatic monoamines. These primary and secondary amines may be selected from a multitude of amines which bear hydrocarbyl radicals which may optionally be bonded to one another.

These parent amines of the oil-soluble reaction products of component (K4) are usually secondary amines and have the general formula $HN(R^6)_2$ in which the two variables RP are each independently straight-chain or branched $C_{10}$- to $C_{30}$-alkyl radicals, especially $C_{14}$- to $C_{24}$-alkyl radicals. These relatively long-chain alkyl radicals are preferably straight-chain or only slightly branched. In general, the secondary amines mentioned, with regard to their relatively long-chain alkyl radicals, derive from naturally occurring fatty acids and from derivatives thereof. The two FR radicals are preferably identical.

The secondary amines mentioned may be bonded to the polycarboxylic acids by means of amide structures or in the form of the ammonium salts; it is also possible for only a portion to be present as amide structures and another portion as ammonium salts. Preferably only few, if any, free acid groups are present. The oil-soluble reaction products of component (K4) are preferably present completely in the form of the amide structures.

Typical examples of such components (K4) are reaction products of nitrilotriacetic acid, of ethylenediaminetetraacetic acid or of propylene-1,2-diaminetetraacetic acid with in each case 0.5 to 1.5 mol per carboxyl group, especially 0.8 to 1.2 mol per carboxyl group, of dioleylamine, dipalmitamine, dicocoamine, distearylamine, dibehenylamine or especially ditallamine. A particularly preferred component (K4) is the reaction product of 1 mol of ethylenediaminetetraacetic acid and 4 mol of hydrogenated ditallamine.

Further typical examples of component (K4) include the N,N-dialkylammonium salts of 2-N',N'-dialkylamidobenzoates, for example the reaction product of 1 mol of phthalic anhydride and 2 mol of ditallamine, the latter being hydrogenated or unhydrogenated, and the reaction product of 1 mol of an alkenyispirobislactone with 2 mol of a dialkylamine, for example ditallamine and/or tallamine, the latter two being hydrogenated or unhydrogenated.

Further typical structure types for the component of class (K4) are cyclic compounds with tertiary amino groups or condensates of long-chain primary or secondary amines with carboxylic acid-containing polymers, as described in WO 93/18115.

Sulfocarboxylic acids, sulfonic acids or derivatives thereof which are suitable as cold flow improvers of the component of class (K5) are, for example, the oil-soluble carboxamides and carboxylic esters of ortho-sulfobenzoic acid, in which the sulfonic acid function is present as a sulfonate with alkyl-substituted ammonium cations, as described in EP-A 261 957.

Poly(meth)acrylic esters suitable as cold flow improvers of the component of class (K6) are either homo- or copolymers of acrylic and methacrylic esters. Preference is given to copolymers of at least two different (meth)acrylic esters which differ with regard to the esterified alcohol. The copolymer optionally comprises another different olefinically unsaturated monomer in copolymerized form. The weight-average molecular weight of the polymer is preferably 50 000 to 500 000. A particularly preferred polymer is a copolymer of methacrylic acid and methacrylic esters of saturated $C_{14}$- and $C_{15}$-alcohols, the acid groups having been neutralized with hydrogenated tallamine. Suitable poly (meth)acrylic esters are described, for example, in WO 00/44857.

The cold flow improver or the mixture of different cold flow improvers is added to the middle distillate fuel or diesel fuel in a total amount of preferably 10 to 5000 ppm by weight, more preferably of 20 to 2000 ppm by weight, even more preferably of 50 to 1000 ppm by weight and especially of 100 to 700 ppm by weight, for example of 200 to 500 ppm by weight.

B4) LUBRICITY IMPROVERS

Suitable lubricity improvers or friction modifiers are based typically on fatty acids or fatty acid esters. Typical examples are tall oil fatty acid, as described, for example, in WO 98/004656, and glyceryl monooleate. The reaction products, described in U.S. Pat. No. 6,743,266 B2, of natural or synthetic oils, for example triglycerides, and alkanolamines are also suitable as such lubricity improvers.

B5) CORROSION INHIBITORS OTHER THAN THE COPOLYMER DESCRIBED

Suitable corrosion inhibitors are, for example, succinic esters, in particular with polyols, fatty acid derivatives, for example oleic esters, oligomerized fatty acids, substituted ethanolamines, and products sold under the trade name RC 4801 (Rhein Chemie Mannheim, Germany), Irgacor® L12 (BASF SE) or HiTEC 536 (Ethyl Corporation).

B6) DEMULSIFIERS

Suitable demulsifiers are, for example, the alkali metal or alkaline earth metal salts of alkyl-substituted phenol- and naphthalenesulfonates and the alkali metal or alkaline earth metal salts of fatty acids, and also neutral compounds such as alcohol alkoxylates, e.g. alcohol ethoxylates, phenol alkoxylates, e.g. tert-butylphenol ethoxylate or tert-pentylphenol ethoxylate, fatty acids, alkylphenols, condensation products of ethylene oxide (EO) and propylene oxide (PO), for example including in the form of EO/PO block copolymers, polyethyleneimines or else polysiloxanes.

B7) DEHAZERS

Suitable dehazers are, for example, alkoxylated phenol-formaldehyde condensates, for example the products available under the trade names NALCO 7D07 (Nalco) and TOLAD 2683 (Petrolite).

B8) ANTIFOAMS

Suitable antifoams are, for example, polyether-modified polysiloxanes, for example the products available under the trade names TEGOPREN 5851 (Goldschmidt), Q 25907 (Dow Corning) and RHODOSIL (Rhone Poulenc).

B9) CETANE NUMBER IMPROVERS

Suitable cetane number improvers are, for example, aliphatic nitrates such as 2-ethylhexyl nitrate and cyclohexyl nitrate and peroxides such as di-tert-butyl peroxide.

B10) ANTIOXIDANTS

Suitable antioxidants are, for example substituted phenols, such as 2,6-di-tert-butylphenol and 6-di-tert-butyl-3-methylphenol, and also phenylenediamines such as N,N'-di-sec-butyl-p-phenylenediamine.

B11) METAL DEACTIVATORS

Suitable metal deactivators are, for example, salicylic acid derivatives such as N,N'-disalicylidene-1,2-propanediamine.

B12) SOLVENTS

Suitable solvents are, for example, nonpolar organic solvents such as aromatic and aliphatic hydrocarbons, for example toluene, xylenes, white spirit and products sold under the trade names SHELLSOL (Royal Dutch/Shell Group) and EXXSOL (ExxonMobil), and also polar organic solvents, for example, alcohols such as 2-ethylhexanol, decanol and isotridecanol. Such solvents are usually added to the diesel fuel together with the aforementioned additives and coadditives, which they are intended to dissolve or dilute for better handling.

C) FUELS

The inventive additive is outstandingly suitable as a fuel additive and can be used in principle in any fuels. It brings about a whole series of advantageous effects in the operation of internal combustion engines with fuels. Preference is given to using the inventive quaternized additive in middle distillate fuels, especially diesel fuels.

The present invention therefore also provides fuels, especially middle distillate fuels, with a content of the inventive quaternized additive which is effective as an additive for achieving advantageous effects in the operation of internal combustion engines, for example of diesel engines, especially of direct injection diesel engines, in particular of diesel engines with common rail injection systems. This effective content (dosage rate) is generally 10 to 5000 ppm by weight, preferably 20 to 1500 ppm by weight, especially 25 to 1000 ppm by weight, in particular 30 to 750 ppm by weight, based in each case on the total amount of fuel.

The inventive use relates in principle to any fuels, preferably diesel fuels and gasoline fuels.

Middle distillate fuels such as diesel fuels or heating oils are preferably mineral oil raffinates which typically have a boiling range from 100 to 400° C. These are usually distillates having a 95% point up to 360° C. or even higher. These may also be what is called "ultra low sulfur diesel" or "city diesel", characterized by a 95% point of, for example, not more than 345° C. and a sulfur content of not more than 0.005% by weight or by a 95% point of, for example, 285° C. and a sulfur content of not more than 0.001% by weight. In addition to the mineral middle distillate fuels or diesel fuels obtainable by refining, those obtainable by coal gasification or gas liquefaction ["gas to liquid" (GTL) fuels] or by biomass liquefaction ["biomass to liquid" (BTL) fuels] are also suitable. Also suitable are mixtures of the aforementioned middle distillate fuels or diesel fuels with renewable fuels, such as biodiesel or bioethanol.

The qualities of the heating oils and diesel fuels are laid down in detail, for example, in DIN 51603 and EN 590 (cf. also Ullmann's Encyclopedia of Industrial Chemistry, 5th edition, Volume A12, p. 617 ff.).

The inventive use in middle distillate fuels of fossil, vegetable or animal origin, which are essentially hydrocarbon mixtures, also relates to mixtures of such middle distillates with biofuel oils (biodiesel). Mixtures of this kind are encompassed by the term "middle distillate fuel". They are commercially available and usually comprise the biofuel oils in minor amounts, typically in amounts of 1 to 30% by weight, especially of 3 to 10% by weight, based on the total amount of middle distillate of fossil, vegetable or animal origin and biofuel oil.

Biofuel oils are generally based on fatty acid esters, preferably essentially on alkyl esters of fatty acids which derive from vegetable and/or animal oils and/or fats. Alkyl esters are typically understood to mean lower alkyl esters, especially $C_1$- to $C_4$-alkyl esters, which are obtainable by transesterifying the glycerides which occur in vegetable and/or animal oils and/or fats, especially triglycerides, by means of lower alcohols, for example ethanol or in particular methanol ("FAME"). Typical lower alkyl esters based on vegetable and/or animal oils and/or fats, which find use as a biofuel oil or components thereof, are, for example, sunflower methyl ester, palm oil methyl ester ("PME"), soya oil methyl ester ("SME") and especially rapeseed oil methyl ester ("RME").

The middle distillate fuels or diesel fuels are more preferably those having a low sulfur content, i.e. having a sulfur content of less than 0.05% by weight, preferably of less than 0.02% by weight, more particularly of less than 0.005% by weight and especially of less than 0.001% by weight of sulfur.

Useful gasoline fuels include all commercial gasoline fuel compositions. One typical representative which shall be mentioned here is the Eurosuper base fuel to EN 228, which is customary on the market. In addition, gasoline fuel compositions of the specification according to WO 00/47698 are also possible fields of use for the present invention.

The inventive quaternized additive is especially suitable as a fuel additive in fuel compositions, especially in diesel fuels, for overcoming the problems outlined at the outset in direct injection diesel engines, in particular in those with common rail injection systems.

The invention is now described in detail by the working examples which follow. More particularly, the test methods specified hereinafter are part of the general disclosure of the application and are not restricted to the specific working examples.

EXPERIMENTAL SECTION

A. Analysis

GPC Analysis

Unless stated otherwise, the mass-average molecular weight Mw and number-average molecular weight Mn of the copolymers was measured by means of gel permeation chromatography (GPC). GPC separation was effected by means of two PLge Mixed B columns (Agilent) in tetrahydrofuran at 35° C. Calibration was effected by means of a narrow-distribution polystyrene standard (from PSS, Germany) having a molecular weight of 162-50 400 Da. Hexylbenzene was used as a marker for low molecular weight.

B. Preparation Examples

General Procedure

A reactor having an anchor stirrer was initially charged with the olefin or the mixture of olefins with or without solvent (as a bulk polymerization). The mixture was heated to the temperature specified under a nitrogen stream and while stirring. To this were added the free-radical initiator specified (optionally diluted in the same solvent) and molten maleic anhydride (1 equivalent based on olefin monomer). The reaction mixture was stirred at the same temperature for the reaction time specified and then cooled down.

If hydrolysis is desired, water was subsequently added in the amount specified and the mixture was stirred either at 95° C. for 10-14 h or under pressure at 110° C. for 3 h.

Synthesis Example 1

A 2 L glass reactor having an anchor stirrer was initially charged with a mixture of $C_{20}$-$C_{24}$ olefins (363.2 g, average molar mass 296 g/mol) and Solvesso 150 (231.5 g, DHC Solvent Chemie GmbH, Speldorf). The mixture was heated to 160° C. in a nitrogen stream and while stirring. To this were added, within 5 h, a solution of di-tert-butyl peroxide (29.6 g, from Akzo Nobel) in Solvesso 150 (260.5 g) and molten maleic anhydride (120.3 g). The reaction mixture was stirred at 160° C. for 1 h and then cooled down. The active ingredient content was about 40%.

GPC (in THF) gave an Mn=1210 g/mol, Mw=2330 g/mol for the copolymer, which corresponds to a polydispersity of 1.9.

Synthesis Example 2 (Comparison, Example 3 of PCT/EP2014/076622)

Water (19.9 g) was added to the product from synthesis example 1 at a temperature of 95° C. within 3 h and the mixture was then stirred for a further 11 h. The acid number was 104 mg KOH/g.

C. Use Examples

Use Example 1: DW10 Na Soap IDID Test (Clean-Up)

To examine the influence of the additives on the performance of direct injection diesel engines, as a further test method, the IDID engine test, in which the exhaust gas temperatures in the cylinders at the cylinder outlet were determined on cold starting of the DW10 engine was. A direct injection diesel engine with common rail system from the manufacturer Peugeot as per test method CEC F-098-08 was used. The fuel used was a commercial B7 diesel fuel according to EN 590 from Aral. To artificially induce the formation of deposits, 1 ppm by weight of sodium naphthenate and 20 ppm by weight of dodecenylsuccinic acid were added thereto in each case.

Similarly to the CEC F-98-08 method, the engine power is measured during the test. The test consisted of two parts:

I. Dirty-Up:

The test was conducted without addition of compounds according to this invention. The test was shortened to 8 hours; the CEC F-98-08 method was conducted without addition of Zn, but with addition of sodium naphthenate and dodecenylsuccinic acid. If significant deviations in exhaust gas temperatures were observed, the test was stopped before the 8-hour mark was reached, in order to avoid engine damage. After the dirty-up run, the engine was left to cool and then restarted and operated in idling mode for 10 minutes. During these 10 minutes, the engine was warmed up. The exhaust gas temperature of each cylinder was recorded. The smaller the differences between the exhaust gas temperatures found, the smaller the amount of IDIDs formed.

The exhaust gas temperatures of the 4 cylinders ("C1" to "C4") were measured at each of the cylinder outlets after 0 minutes ("ϑ0") and after 10 minutes ("ϑ10"). The results of the exhaust gas temperature measurements with average values ("Δ") and the greatest differences from Δ in the downward ("−") and upward ("+") directions for the two test runs are summarized in the overview which follows.

II. Clean-Up:

The test was shortened to 8 hours; the CEC F-98-08 method was conducted without addition of Zn. However, 1 ppm by weight of sodium naphthenate and 20 ppm by weight of dodecenylsuccinic acid, and also an inventive compound, were added in each case, and the engine power was determined.

After the clean-up, the engine was cooled and restarted. The exhaust gas temperature of each cylinder was recorded. The smaller the differences between the exhaust gas temperatures found, the smaller the amount of IDIDs formed.

The exhaust gas temperatures of the 4 cylinders ("C1" to "C4") were measured at each of the cylinder outlets after 0 minutes ("ϑ0") and after 10 minutes ("ϑ10"). The results of the exhaust gas temperature measurements with average values ("Δ") and the greatest differences from Δ in the downward ("−") and upward ("+") directions are summarized in the overview which follows.

The following results were found:

Dirty-up clean-up sequence 1:

After dirty-up:

| | | | | |
|---|---|---|---|---|
| ϑ0 | C1: 29° C. | C2: 21° C. | C3: 21° C. | C4: 20° C. |
| ϑ10 | C1: 81° C. | C2: 59° C. | C3: 73° C. | C4: 67° C. |
| Δ: 70° C. | (+11° C./−11° C.) | | | |

Significant deviations from the mean and significant differences between the individual cylinders show the presence of IDIDs.

Clean-up:

After clean-up with 40 ppm of additive according to synthesis example 1 in the presence of 1 ppm of Na+20 ppm of dodecenylsuccinic acid:

| | | | | |
|---|---|---|---|---|
| ϑ0 | C1: 34° C. | C2: 36° C. | C3: 28° C. | C4: 32° C. |
| ϑ10 | C1: 77° C. | C2: 76° C. | C3: 67° C. | C4: 64° C. |
| Δ: 61° C. | (−7° C./+6° C.) | | | |

The deviation from the mean temperature of the exhaust gases is low, which suggests the removal of IDIDs.

Thus, the compounds according to the present invention are very efficient in prevention/removal in engines having direct injection, as can be seen from the Peugeot DW10 engine in a test similar to CEC F-98-08, except with 1 ppm by weight of sodium in the form of sodium naphthenate and 20 ppm by weight of dodecenylsuccinic acid.

The invention claimed is:

1. A method for enhancing the performance of a direct injection diesel and/or gasoline engine, the method comprising:

adding a copolymer to a fuel composition, lubricant composition, or kerosene composition, wherein the copolymer consists of, in a copolymerized form:

(A) at least one selected from the group consisting of an ethylenically unsaturated dicarboxylic acid anhydride, a mono-$C_1$-$C_4$-alkyl ester of an ethylenically unsaturated monocarboxylic acid, a di-$C_1$-$C_4$-alkyl ester of an ethylenically unsaturated dicarboxylic acid, a mixed ester having different $C_1$-$C_4$-alkyl components of an ethylenically unsaturated monocarboxylic acid and a mixed ester having different $C_1$-$C_4$-alkyl components of an ethylenically unsaturated dicarboxylic acid, optionally, a dicarboxylic acid or monocarboxylic acid which is the hydrolysis product of (A), with the proviso that if hydrolysis is performed more than 90% of the anhydride and carboxylic ester functionalities of (A) remain intact, (B) at least one α-olefin having from at least 12 up to and including 30 carbon atoms, (C) optionally at least one further aliphatic or cycloaliphatic olefin which has at least 4 carbon atoms and is different than (B), and (D) optionally one or more further copolymerizable monomers other than monomers (A), (B) and (C), selected from the group consisting of (Da) vinyl esters, (Db) vinyl ethers, (Dc) (meth)acrylic esters of alcohols having at least 5 carbon atoms, (Dd) allyl alcohols or ethers thereof, and (De) ethylenically unsaturated aromatics;

wherein the addition of the copolymer eliminates or avoids the deposits of salts of ions selected from the group consisting of zinc, sodium, calcium and potassium.

2. The method of claim 1, wherein the copolymer is used as an additive for reducing fuel consumption of a direct injection diesel engine.

3. The method of claim 1, wherein the copolymer is used as an additive for minimizing power loss in a direct injection diesel engine.

4. The method of claim 3, wherein the power loss is a power loss caused by K, Zn, Ca and/or Na ions.

5. The method of claim 1, wherein the copolymer is used as a gasoline fuel additive for reducing the level of at least one deposit in intake system of a gasoline engine.

6. The method of claim 1, wherein the copolymer is used as a diesel fuel additive for reducing and/or preventing the deposit in the fuel system, and/or valve sticking in a direct injection diesel engine.

7. The method of claim 6, wherein the copolymer is used as a diesel fuel additive for reducing and/or preventing internal diesel injector deposits (IDIDs) caused by Na, Ca and/or K ions.

8. The method of claim 6, wherein the copolymer further reduces or prevents internal diesel injector deposits (IDIDs) caused by polymeric deposits.

9. The method of claim 1, wherein the fuel is selected from the group consisting of diesel fuels, biodiesel fuels, gasoline fuels, and alkanol-containing gasoline fuels.

10. The method of claim 1, wherein maleic anhydride is used as component (A) and the optional partly hydrolyzing is not conducted.

11. The method of claim 1, wherein maleic anhydride is used as component (A) and more than 90% and up to 99.9% of the anhydride functionalities remain intact after any optional hydrolyzing.

12. An additive concentrate, comprising:

a diesel or gasoline fuel additive or lubricant additive, and a copolymer, wherein the copolymer consists of, in a copolymerized form:

(A) at least one selected from the group consisting of an ethylenically unsaturated dicarboxylic acid anhydride, a mono-$C_1$-$C_4$-alkyl ester of an ethylenically unsaturated monocarboxylic acid, a di-$C_1$-$C_4$-alkyl ester of an ethylenically unsaturated dicarboxylic acid, a mixed ester having different $C_1$-$C_4$-alkyl components of an ethylenically unsaturated monocarboxylic acid and a mixed ester having different $C_1$-$C_4$-alkyl components of an ethylenically unsaturated dicarboxylic acid, optionally, a dicarboxylic acid or monocarboxylic acid which is the hydrolysis product of (A), with the proviso that if hydrolysis is performed more than 90% of the anhydride and carboxylic ester functionalities of (A) remain intact, (B) at least one α-olefin having from at least 12 up to and including 30 carbon atoms, (C) optionally at least one further aliphatic or cycloaliphatic olefin which has at least 4 carbon atoms and is different than (B), and (D) optionally one or more further copolymerizable monomers other than monomers (A), (B) and (C), selected from the group consisting of (Da) vinyl esters, (Db) vinyl ethers, (Dc) (meth)acrylic esters of alcohols having at least 5 carbon atoms, (Dd) allyl alcohols or ethers thereof, and (De) ethylenically unsaturated aromatics;

wherein the additive concentrate eliminates or avoids the deposits of salts of ions selected from the group consisting of zinc, sodium, calcium and potassium.

13. A fuel composition, lubricant composition, or kerosene composition, comprising a copolymer, wherein the copolymer consists of, in copolymerized form:

(A) at least one selected from the group consisting of an ethylenically unsaturated dicarboxylic acid anhydride, a mono-$C_1$-$C_4$-alkyl ester of an ethylenically unsaturated monocarboxylic acid, a di-$C_1$-$C_4$-alkyl ester of an ethylenically unsaturated dicarboxylic acid, a mixed ester having different $C_1$-$C_4$-alkyl components of an ethylenically unsaturated monocarboxylic acid and a mixed ester having different $C_1$-$C_4$-alkyl components of an ethylenically unsaturated dicarboxylic acid, optionally, a dicarboxylic acid or monocarboxylic acid which is the hydrolysis product of (A), with the proviso that if hydrolysis is performed more than 90% of the anhydride and carboxylic ester functionalities of (A) remain intact, (B) at least one α-olefin having from at least 12 up to and including 30 carbon atoms, (C) optionally at least one further aliphatic or cycloaliphatic olefin which has at least 4 carbon atoms and is different than (B), and (D) optionally one or more further copolymerizable monomers other than monomers (A), (B) and (C), selected from the group consisting of (Da) vinyl esters, (Db) vinyl ethers, (Dc) (meth)acrylic esters of alcohols having at least 5 carbon atoms, (Dd) allyl alcohols or ethers thereof, and (De) ethylenically unsaturated aromatics;

wherein the additive concentrate eliminates or avoids the deposits of salts of ions selected from the group consisting of zinc, sodium, calcium and potassium.

14. A method for removing and/or preventing at least one deposit in a fuel system, and/or an injection system of a direct injection diesel and/or gasoline engine, the method comprising:

adding the fuel composition, lubricant composition, or kerosene composition of claim 13 to the direct injection diesel and/or gasoline engine.

15. The method of claim 1, wherein the copolymer consists of, in a copolymerized form:

(A) the at least one ethylenically unsaturated mono- or dicarboxylic acid or derivatives thereof, (B) the at least one α-olefin having from at least 12 up to and including 30 carbon atoms, and (C) optionally the at least one further aliphatic or cycloaliphatic olefin which has at least 4 carbon atoms and is different than (B).

16. The method of claim 1, wherein the at least one ethylenically unsaturated mono- or dicarboxylic acid or derivatives thereof (A) is maleic anhydride.

17. The method of claim 1, wherein the at least one α-olefin having from at least 12 up to and including 30 carbon atoms (B) is at least one selected from the group consisting of 1-octadecene, 1-eicosene, 1-docosene, and 1-tetracosene.

18. The method of claim 1, wherein the at least one ethylenically unsaturated mono- or dicarboxylic acid or derivatives thereof (A) is selected from the group consisting of acrylic acid, methacrylic acid, crotonic acid, ethylacrylic acid, methyl acrylate, ethyl acrylate, n-butyl acrylate, methyl methacrylate, maleic acid, maleic anhydride, fumaric acid, itaconic acid, citraconic acid, glutaconic acid, 2,3-dimethylmaleic acid, 2-methylfumaric acid, 2,3-dimethylfumaric acid, methylenemalonic acid, and tetrahydrophthalic acid.

19. The additive concentrate of claim 12, wherein the at least one ethylenically unsaturated mono- or dicarboxylic acid or derivatives thereof (A) is selected from the group consisting of acrylic acid, methacrylic acid, crotonic acid, ethylacrylic acid, methyl acrylate, ethyl acrylate, n-butyl acrylate, methyl methacrylate, maleic acid, maleic anhydride, fumaric acid, itaconic acid, citraconic acid, glutaconic acid, 2,3-dimethylmaleic acid, 2-methylfumaric acid, 2,3-dimethylfumaric acid, methylenemalonic acid, and tetrahydrophthalic acid.

20. The fuel composition, lubricant composition, or kerosene composition of claim 13, wherein the at least one ethylenically unsaturated mono- or dicarboxylic acid or derivatives thereof (A) is selected from the group consisting of acrylic acid, methacrylic acid, crotonic acid, ethylacrylic acid, methyl acrylate, ethyl acrylate, n-butyl acrylate, methyl methacrylate, maleic acid, maleic anhydride, fumaric acid, itaconic acid, citraconic acid, glutaconic acid, 2,3-dimethylmaleic acid, 2-methylfumaric acid, 2,3-dimethylfumaric acid, methylenemalonic acid, and tetrahydrophthalic acid.

* * * * *